US011846908B2

(12) United States Patent
Abe et al.

(10) Patent No.: US 11,846,908 B2
(45) Date of Patent: Dec. 19, 2023

(54) IMAGE FORMING APPARATUS WITH LIQUID GUIDES AND LIQUID OUTLET PORTS

(71) Applicant: BROTHER KOGYO KABUSHIKI KAISHA, Nagoya (JP)

(72) Inventors: Koji Abe, Okazaki (JP); Tomohiro Wada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/814,587

(22) Filed: Jul. 25, 2022

(65) Prior Publication Data

US 2023/0029895 A1 Feb. 2, 2023

(30) Foreign Application Priority Data

Jul. 30, 2021 (JP) ..... 2021-125954

(51) Int. Cl.
*G03G 21/16* (2006.01)
*G03G 15/00* (2006.01)

(52) U.S. Cl.
CPC ..... *G03G 21/1619* (2013.01); *G03G 15/5075* (2013.01)

(58) Field of Classification Search
CPC ..... G03G 21/1619; G03G 21/1633; G03G 15/5075
See application file for complete search history.

(56) References Cited

U.S. PATENT DOCUMENTS

2015/0117893 A1* 4/2015 Makino ..... G03G 21/1619 399/92
2015/0139686 A1* 5/2015 Takenoshita ..... G03G 21/1633 399/107

FOREIGN PATENT DOCUMENTS

JP 2016-138991 A 8/2016

* cited by examiner

*Primary Examiner* — Sandra Brase
(74) *Attorney, Agent, or Firm* — Scully, Scott, Murphy & Presser, PC

(57) ABSTRACT

An image forming apparatus having an image forming apparatus and a first housing is provided. The first housing has a top cover, a front cover, a side cover, a first guide, and a second guide. The front cover has a front wall having a first outlet port and a first upper wall. The side cover has a first side wall having a second outlet port and a second upper wall. The first guide guides liquid entering the first housing to the first outlet port and is connected to the front wall. The second guide guides the liquid entering the first housing to the second outlet port and is connected to the first side wall.

13 Claims, 15 Drawing Sheets

IMAGE FORMING APPARATUS WITH LIQUID GUIDES AND LIQUID OUTLET PORTS

REFERENCE TO RELATED APPLICATIONS

This application claims priority from Japanese Patent Application No. 2021-125954 filed on Jul. 30, 2021. The entire content of the priority application is incorporated herein by reference.

BACKGROUND ART

In an image forming apparatus having an upper housing and a lower housing, the lower housing may have a joint cover, a front cover, a side cover, and a drainer duct.

The joint cover may serve as a connector that connects the upper housing and the lower housing. The front cover may form a front wall of the lower housing. The side cover may form a lateral wall of the lower housing.

The drainer duct may be formed integrally with the side cover and may have a liquid inlet port and a liquid outlet port. An end of the liquid inlet port may be located on an inner side of the side cover and may be open upward. The liquid outlet port may be connected with another end of the liquid inlet port and may be open sideward at a frontward end of the side cover. When liquid flowing down from the upper housing enters the lower housing through a gap between the side cover and the joint cover, the drainer duct may receive the liquid through the liquid inlet port and guide the liquid downward from the liquid outlet port.

DESCRIPTION

Meanwhile, the liquid once flowing downward from the liquid outlet port may be caught in, for example, an area surrounded by a frontward part of the side cover and a sideward part of the front cover and stay inside the lower housing.

The present disclosure is advantageous in that an image forming apparatus, which may restrain liquid entering a first housing from staying inside and drain the liquid outward reliably, is provided.

In the following paragraphs, first and second embodiments of the present disclosure will be described with reference to the accompanying drawings.

FIRST EMBODIMENT

Figure 1:
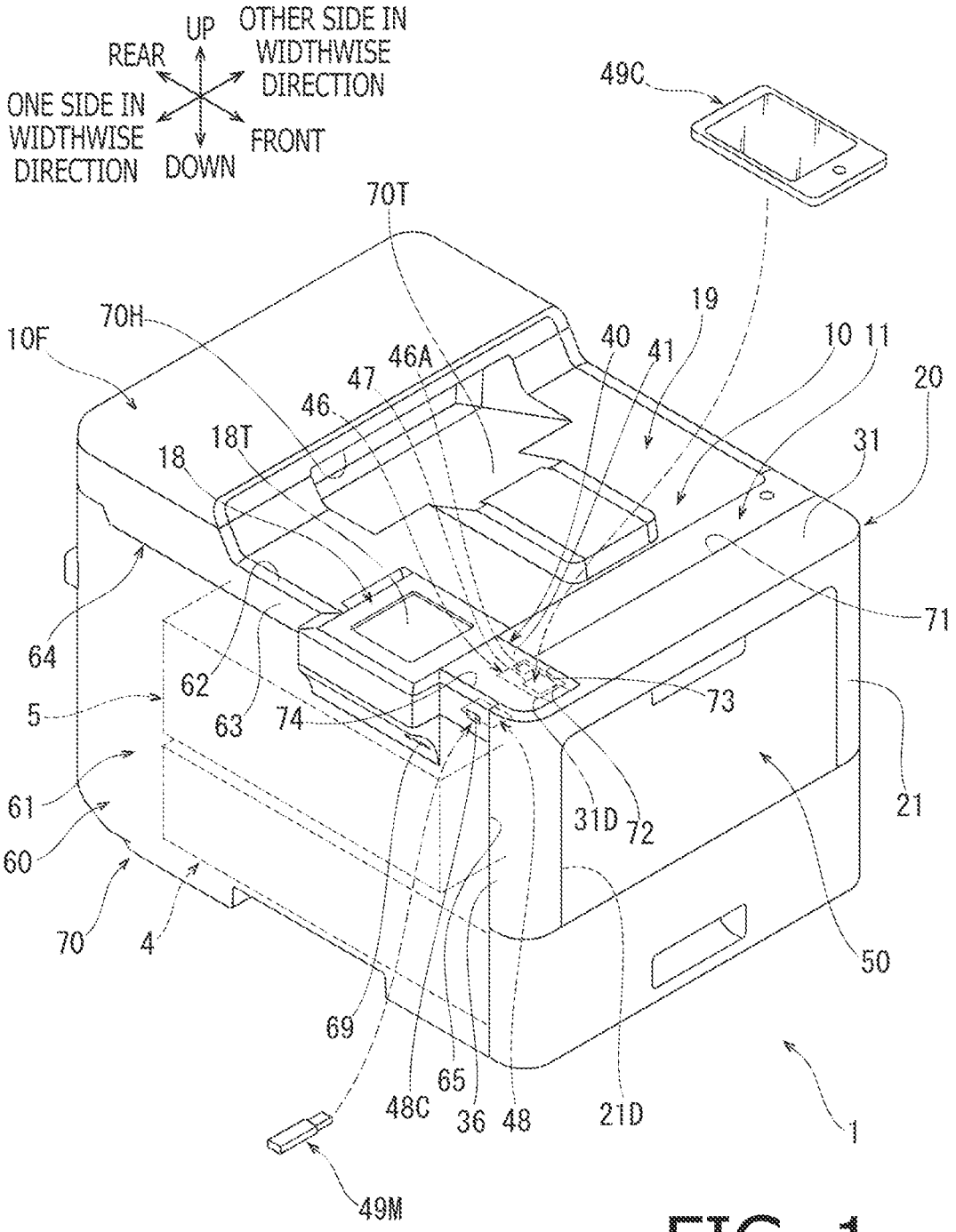
FIG. 1 is a perspective view of an image forming apparatus with a front cover located at a third position and a sub cover located at a first position.

An image forming apparatus 1 shown in FIG. 1 is an example of the present disclosure. As shown in FIG. 1, in the present embodiment, a side of the image forming apparatus 1, on which a front cover 20 is arranged, is defined as a front side. A widthwise direction of the image forming apparatus 1 intersects orthogonally with a front-to-rear or rear-to-front direction (hereinafter, "front-rear direction") and extends in a horizontal direction. A side on a left-hand side of a user who faces the front cover 20 and a side on a right-hand side of the user will be defined as one side and the other side in the widthwise direction, respectively. Moreover, the directions in FIG. 2-15 will be defined in the same manner as FIG. 1.

<Overall Configuration>

As shown in FIG. 1, the image forming apparatus 1 includes a first housing 70, an image forming device 5, a sheet tray 4, and a touch panel 18.

Figure 2:
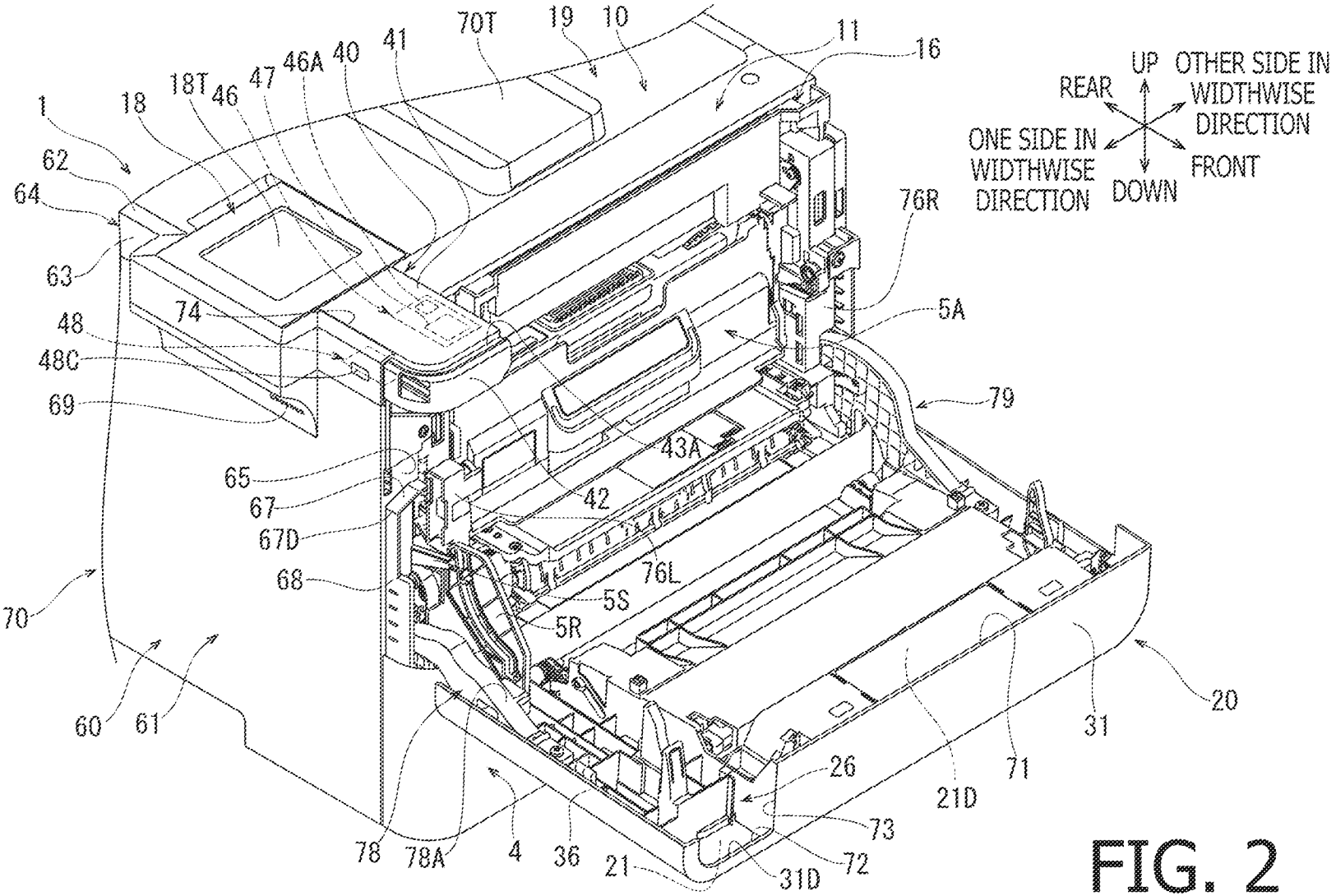
FIG. 2 is a perspective partial view of the image forming apparatus with the front cover located at a fourth position.

The first housing 70 is substantially in a form of a box. As shown in FIG. 2, the first housing 70 includes a pair of side frames 76L, 76R. The side frame 76L is located on a side of the image forming apparatus 1 toward the one side in the widthwise direction and extends in the front-rear direction and in a vertical direction. The side frame 76R is located on a side of the image forming apparatus 1 toward the other side in the widthwise direction and extends in the front-rear direction and in the vertical direction.

As shown in FIG. 1, the first housing 70 accommodates the sheet tray 4 in a lower area. The sheet tray 4 may support a sheet or a stack of sheets, on which images may be formed, thereon.

The first housing 70 accommodates the image forming device 5 in an upper area with respect to the sheet tray 4. The image forming device 5 may form electro-photographic images on the sheets conveyed from the sheet tray 4.

As shown in FIG. 2, the image forming device 5 has a drawer unit 5A. The drawer unit 5A includes a photosensitive drum, a developing roller, and a toner container, which are not shown, and forms a part of the image forming device 5. The side frames 76L, 76R support the drawer unit 5A movably with respect to the first housing 70. The drawer unit 5A is movable to be drawn frontward to the outside from the first housing 70.

As shown in FIG. 1, the first housing 70 has a sheet outlet 70H and an ejection tray 70T on an upper side thereof. The sheet, on which an image is formed by the image forming device 5, may be pushed frontward through the sheet outlet 70H and ejected. The ejection tray 70T may catch and support the sheet ejected outside through the sheet outlet 70H.

The first housing 70 accommodates the touch panel 18, a near-field wireless communication board 46, and an external-memory connector board 48 in an upper area with respect to the image forming device 5.

An operative surface 18T of the touch panel 18 is located on a side of the ejection tray 70T on an upper side of the first housing 70 toward the one side in the widthwise direction and is exposed upward. A controller, which is not shown, may control the touch panel 18 to display various types of information such as settings and ongoing operations of the image forming device 5 through the operative surface 18T. Moreover, the controller may acquire information concerning operations input by the user who touches the operative surface 18T from the touch panel 18.

The near-field wireless communication board 46 is located at a position below an upper face of the first housing 70 on a frontward corner on the one side in the widthwise direction. The near-field wireless communication board 46 is not exposed outward.

The near-field wireless communication board 46 includes a communication circuit 46A and a looped antenna circuit 47. The communication circuit 46A may communicate in a near field with an external device 49C, which may be held at a position above the near-field wireless communication board 46 by the user, by exchanging short-range radio waves through the antenna circuit 47.

The external device 49C may be, for example, a portable information terminal such as smartphone. The controller may receive information, including information of an image to be formed on the sheet and setting information, from the external device 49C; transmit information to the external device 49C; and/or authenticate the external device 49C based on the information received from the external device 49C. The external device may be, for another example, an IC card.

The external-memory connector board 48 is located at a position below the upper face of the first housing 70 on the frontward corner on the one side in the widthwise direction at a position lower than the near-field wireless communication board 46. The external-memory connector board 48 has a connector 48C. An end of the connector 48C is exposed sideward on the one side of the first housing 70 in the widthwise direction and is connectable with an external memory 49M.

The external memory 49M is a memory medium such as, for example, a USB memory. The connector 48C is a connector terminal for information devices and may be, for example, a USB connector. The controller may read information, including information of an image to be formed on the sheet and setting information, from the external memory 49M and write information in the external memory 49M.

<Exterior Cover of First Housing>

The first housing 70 includes a top cover 10, a covering body 10F, a side cover 60, and a front cover 20, which form an exterior cover of the image forming apparatus 1. The top cover 10, the covering body 10F, the side cover 60, and the front cover 20 may be resin-molded pieces that may be formed by injection molding of thermoplastic resin.

<Top Cover>

The top cover 10 has a top-cover body 19, a first cover 11, and a second cover 40.

The top-cover body 19 delimits edges of the sheet outlet 70H in a rearward area thereof. In other words, the top-cover body 19 forms a lower end and widthwise ends on the one side and the other side in the widthwise direction of the sheet outlet 70H. The top-cover body 19 is located above the image forming device 5 and covers the image forming device 5 from above. An upper face of the top-cover body 19 forms the ejection tray 70T in a frontward area with respect to the sheet outlet 70H.

Figure 3:
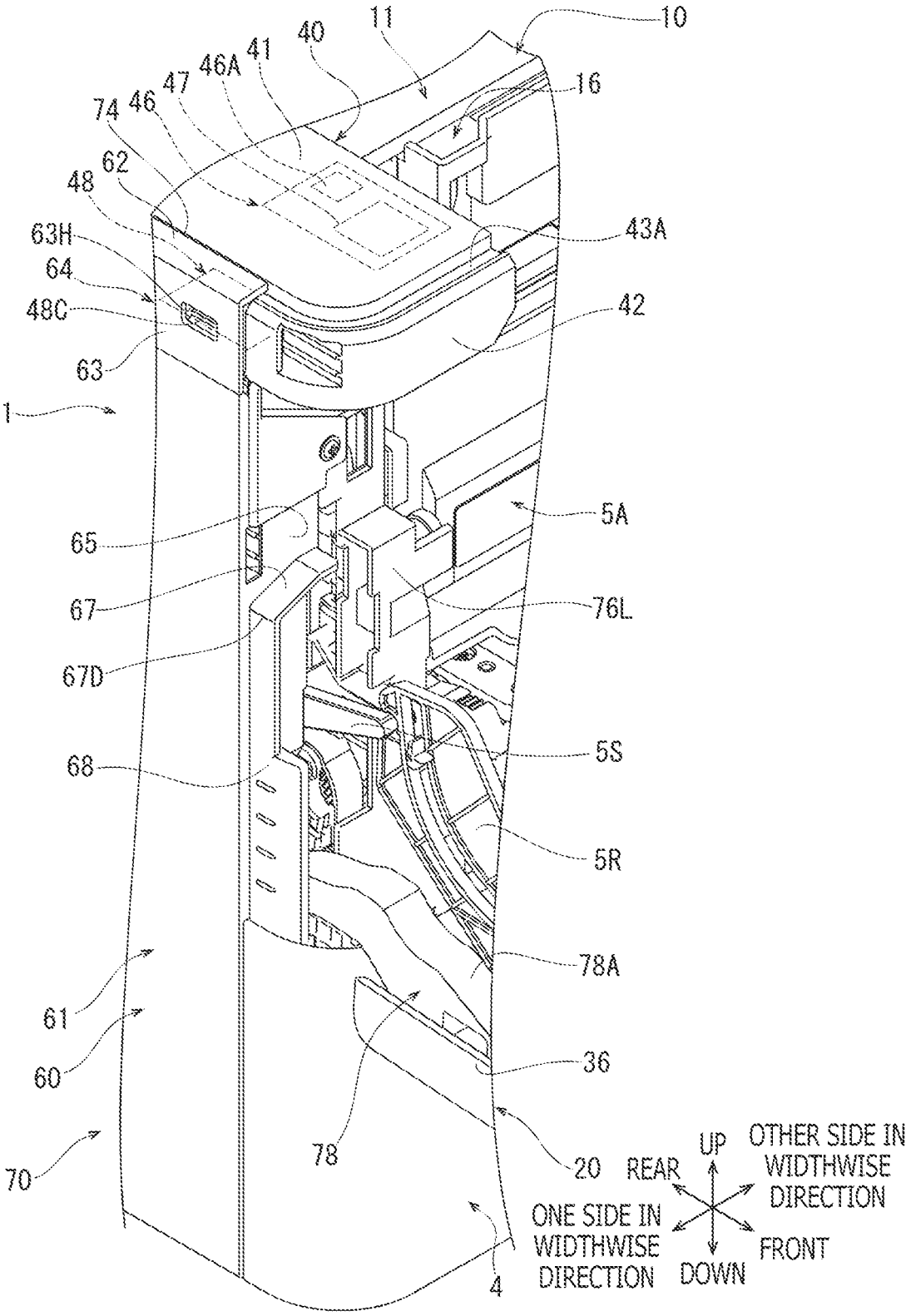
FIG. 3 is a partially enlarged perspective view of a second cover and a neighboring area in the image forming apparatus.
Figure 4:
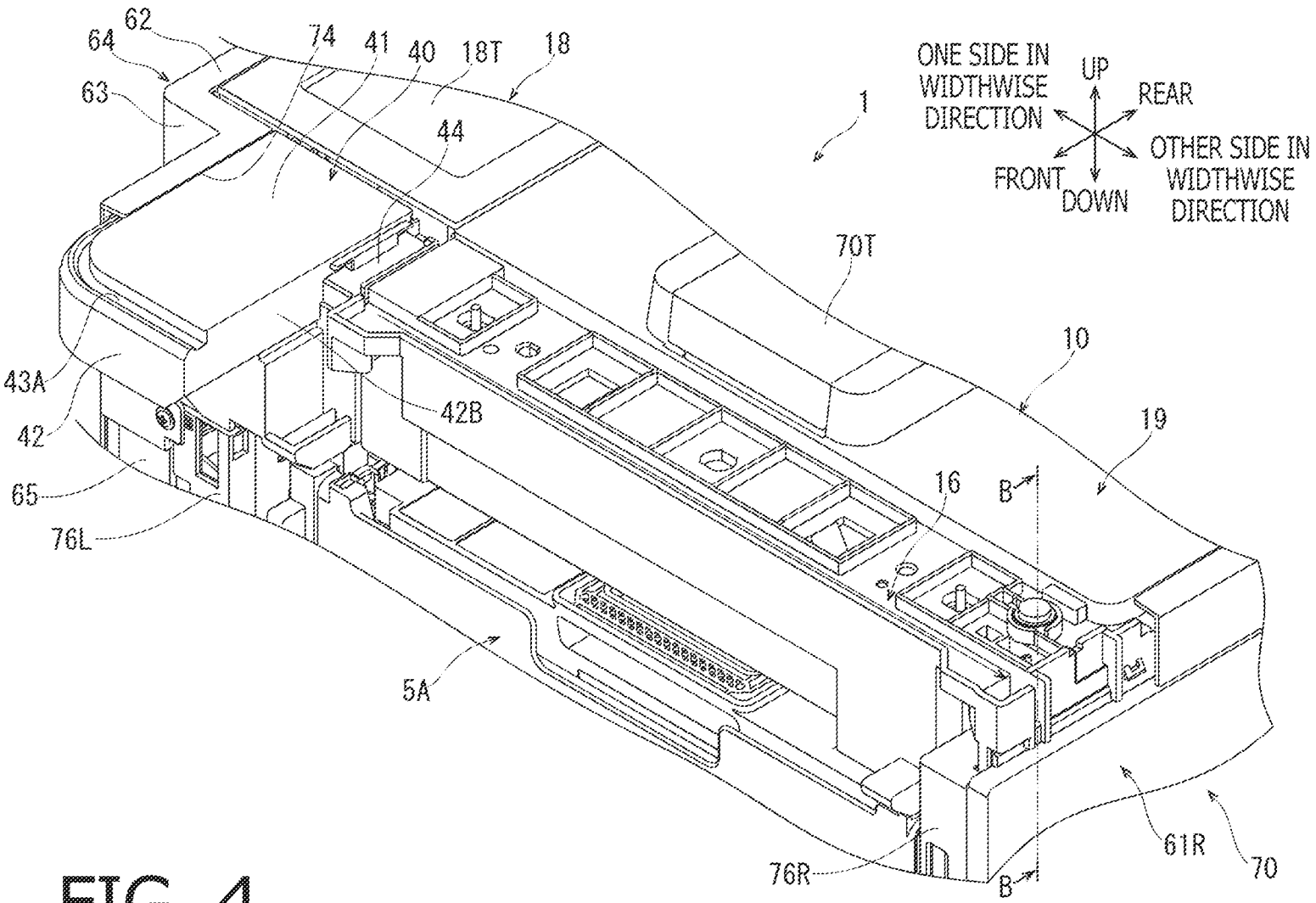
FIG. 4 is a perspective partial view of the second cover and the neighboring area, with a first cover being removed, viewed at an angle different from FIG. 2.

As shown in FIGS. 2-4, the top-cover body 19 has a third guide 16 at a frontward position with respect to the ejection tray 70T. As shown in FIG. 4, the third guide 16 is in a tier lower than the ejection tray 70T. The third guide 16 may have a form of a gutter having a plurality of ribs that protrude upward from an upper surface of a bottom and extend in the widthwise direction.

As shown in FIG. 2, the third guide 16 supports the first cover 11 from a lower side. The first cover 11 covers a large part of the third guide 16 from above. A frontward end of the third guide 16 juts frontward with respect to a frontward end of the first cover 11. An upper face of the first cover 11 forms an exterior surface of the top cover 10 at a frontward area with respect to the ejection tray 70T.

The second cover 40 is located at a frontward corner on the one side in the widthwise direction on the upper side of the first housing 70 and is connected with the top-cover body 19.

The second cover 40 is located at a position toward the one side in the widthwise direction with respect to the first cover 11. The second cover 40 aligns in line with a rearward end of the first cover 11 at a rearward end thereof, and a frontward end of the second cover 40 is separated frontward from a frontward end of the first cover 11. In other words, the frontward end of the second cover 40 is located frontward with respect to the first cover 11. Meanwhile, the second cover 40 is smaller than the first cover 11 in the widthwise direction. The second cover 40 will be described more in detail below.

<Covering Body>

As shown in FIG. 1, the covering body 10F is located at a rearward and upper position with respect to the ejection tray 70T, and a frontward end of the covering body 10F forms an upper end of the sheet outlet 70H. The covering body 10F covers a rearward area of the image forming device 5 from above.

<Side Cover>

Figure 5:
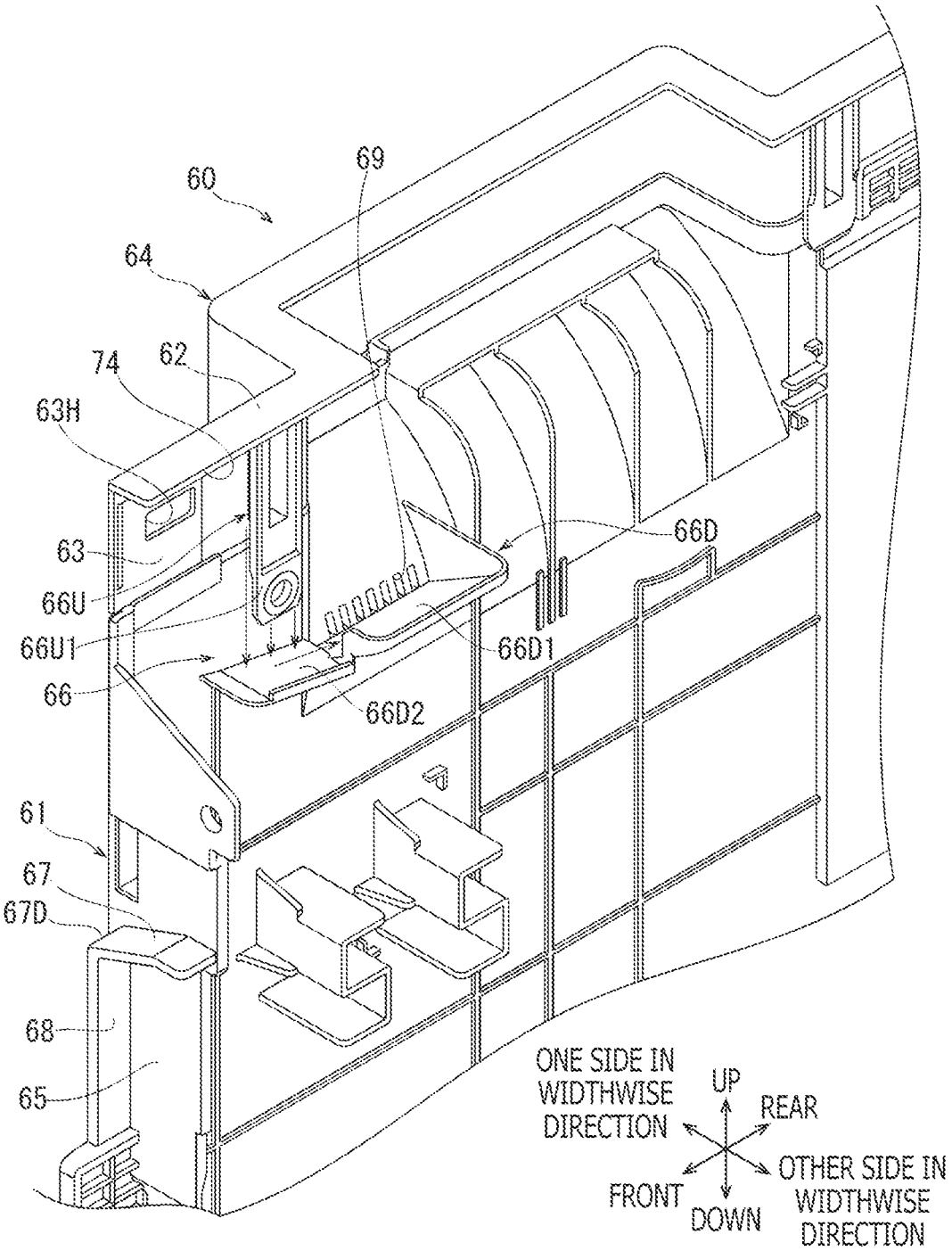
FIG. 5 is a perspective partial view of a side cover including a side-cover body and an upper side cover.

As shown in FIGS. 1 and 5, the side cover 60 has a side-cover body 61 and an upper side cover 64.

As shown in FIG. 1, the side-cover body 61 is substantially in a form of a plate spreading in the front-rear direction and the vertical direction. The side-cover body 61 is located at a side of the image forming device 5 on the one side in the widthwise direction and covers the image forming device 5 from the one side in the widthwise direction. The side-cover body 61 bulges outward at a sideward part on the one side in the widthwise direction corresponding to a part of the touch panel 18 that protrudes outward toward the one side in the widthwise direction.

The upper side cover 64 is located above the side-cover body 61. The upper side cover 64 has a side wall 63 and a second upper wall 62.

A rearward portion of the side wall 63 is located at a position below an edge of the covering body 10F on the one side in the widthwise direction and extends longer in the front-rear direction and shorter in the vertical direction. A frontward portion of the side wall 63 extends longer in the front-rear direction, bending around edges of the protruded part of the touch panel 18 on the one side in the widthwise direction and along an edge of the second cover 40 on the one side in the widthwise direction, and shorter in the vertical direction. The side wall 63 covers, together with the side-cover body 61, the image forming device 5 sideward from the one side in the widthwise direction.

The side-cover body 61 and the side wall 63 of the upper side cover 64 forms a first side wall in the image forming apparatus 1.

The second upper wall 62 extends from an upper edge of the frontward portion of the side wall 63 and is elongated toward the touch panel 18 and the second cover 40. The second upper wall 62 is arranged alongside, at least in the widthwise direction, edges of the top-cover body 19 on the one side in the widthwise direction, the part of the touch panel 18 that protrudes outward on the one side in the widthwise direction, and the second cover 40 on the one side in the widthwise direction.

As shown in FIGS. 2-3, a frontward end of the side-cover body 61 and a frontward end of the upper side cover 64 align in the front-rear direction. The side-cover body 61 has a facing portion 65. The facing portion 65 extends from the frontward end of the side-cover body 61 toward the other side in the widthwise direction and spreads in the vertical direction and the widthwise direction substantially in a form of a plate.

<Second Cover>

Figure 6:
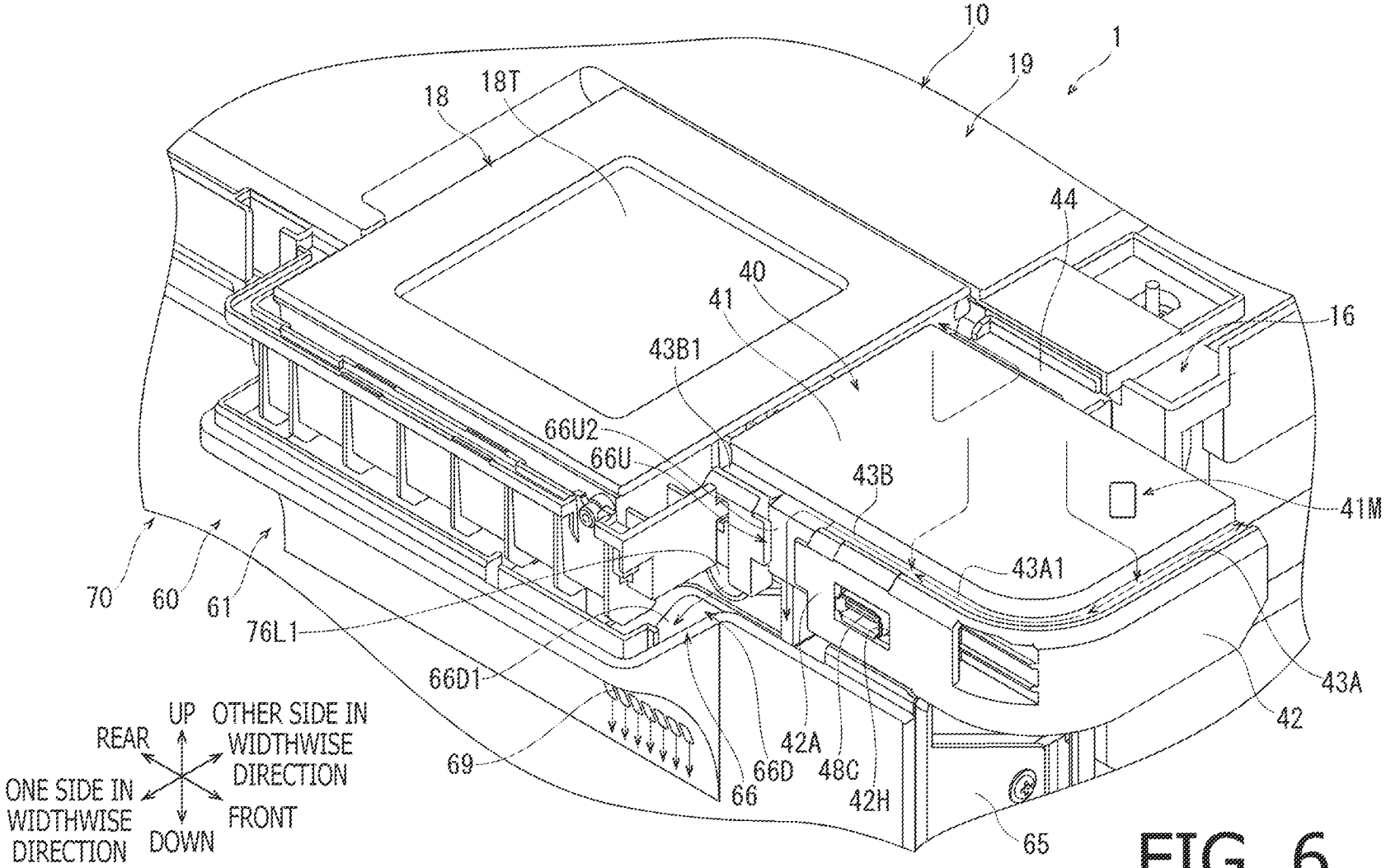
FIG. 6 is another perspective partial view of the second cover and the neighboring area, with the first cover and the upper side cover being removed, viewed at the same angle as FIG. 2.

As shown in FIGS. 3-4, and 6, the second cover 40 has a second-cover body 41, a peripheral wall 42, a guiding protrusion 44, a first groove 43A, and a second groove 43B integrally.

The second-cover body 41 has a form of a substantially rectangular plate with a frontward corner on the one side in the widthwise direction being rounded. The second-cover body 41 is enclosed by a frontward end of the touch panel 18, an edge of the first cover 11 on the one side in the widthwise direction, and a part of the second upper wall 62 of the upper side cover 64 located frontward with respect to the touch panel 18.

The second-cover body 41 protrudes frontward with respect to the frontward end of the first cover 11 and the frontward end of the upper side cover 64.

Figure 7:
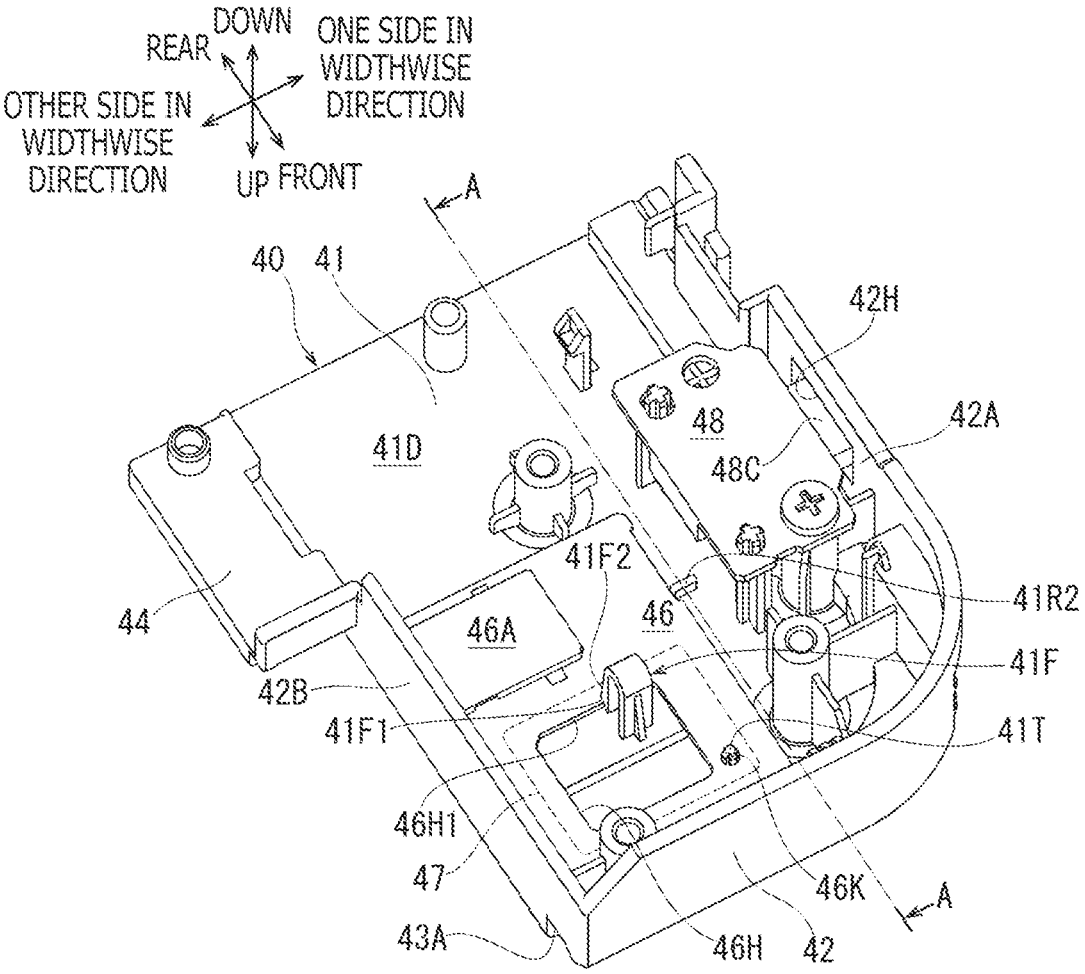
FIG. 7 is a perspective view of a near-field wireless communication board and an external-memory connector board.

As shown in FIG. 7, the peripheral wall 42 extends substantially in a form of "U," in a top plan view, along edges of the second-cover body 41 on a frontward end and widthwise ends on the one side and the other side in the widthwise direction.

As shown in FIG. 4, an upper end of a side wall 42B of the peripheral wall 42 that extends in the front-rear direction on the other side in the widthwise direction is continuous with an edge of the second-cover body 41 on the other side in the widthwise direction. The guiding protrusion 44 protrudes from a lower position in the side wall 42B toward the other side in the widthwise direction.

An upper face of the guiding protrusion 44 is in a tier lower than an upper face of the second-cover body 41. As shown in FIG. 2, a widthwise end of the first cover 11 on the one side in the widthwise direction covers the guiding protrusion 44 from above.

As shown in FIG. 6, an upper edge of the peripheral wall 42 is located to be lower than the upper face of the second-cover body 41, on a frontward side and a widthwise side, on the one side in the widthwise direction, of the second-cover body 41.

The first groove 43A is dented downward between a frontward edge of the second-cover body 41 and the peripheral wall 42 and longitudinally extends in the widthwise direction. The first groove 43A curves along the rounded corner of the second-cover body 41. The first groove 43A has one end and the other end 43A1. The one end of the first groove 43A forms a cutout which is dented from an upper edge of a frontward part of the side wall 42B. A rearward end of the curve of the first groove 43A forms the other end 43A1 of the first groove 43A.

The first groove 43A is located to be lower than a second section 72, which will be described further below. The one end of the first groove 43A is located above a first guide 26, which will be described further below.

The peripheral wall 42 has a second-cover side wall 42A, which extends in the front-rear direction, at a sideward position on the one side in the widthwise direction. The second groove 43B is dented downward between an edge of the second-cover body 41 on the one side in the widthwise direction and the second-cover side wall 42A and extends longitudinally in the front-rear direction.

The other end 43A1 of the first groove 43A is connected with one end of the second groove 43B. The second groove 43B has one end and the other end 43B1. The other end 43B1 of the second groove 43B is arranged alongside the frontward corner of the second-cover body 41 on the one side in the widthwise direction.

As shown in FIG. 2, the side wall 63 of the upper side cover 64 covers the second-cover side wall 42A sideward from the one side in the widthwise direction. The second upper wall 62 of the upper side cover 64 covers the second groove 43B and the second-cover side wall 42A from above.

The second upper wall 62 has a fourth section 74. The fourth section 74 is arranged alongside, in the widthwise direction, the edge of the second-cover body 41 on the one side in the widthwise direction.

The second groove 43B is located below the fourth section 74. The other end 43B1 of the second groove 43B is located above a second guide 66, which will be described further below.

As shown in FIG. 6, the first groove 43A and the second groove 43B may receive liquid spilled on the upper face of the second-cover body 41 and guide to the one end of the first groove 43A and to the other end 43B1 of the second groove 43B.

As shown in FIG. 7, the second cover 40 has the near-field wireless communication board 46 and the external-memory connector board 48 on a lower surface 41D of the second-cover body 41. As shown in FIG. 6, the second cover 40 has a mark 41M indicating a position, over which the user may hold the external device 49C, on the upper face of the second-cover body 41. In FIG. 6, the mark 41M may be shown in a simplified form; however, the mark 41M may have a design that may help the user to comprehend the meaning thereof.

Figure 8:
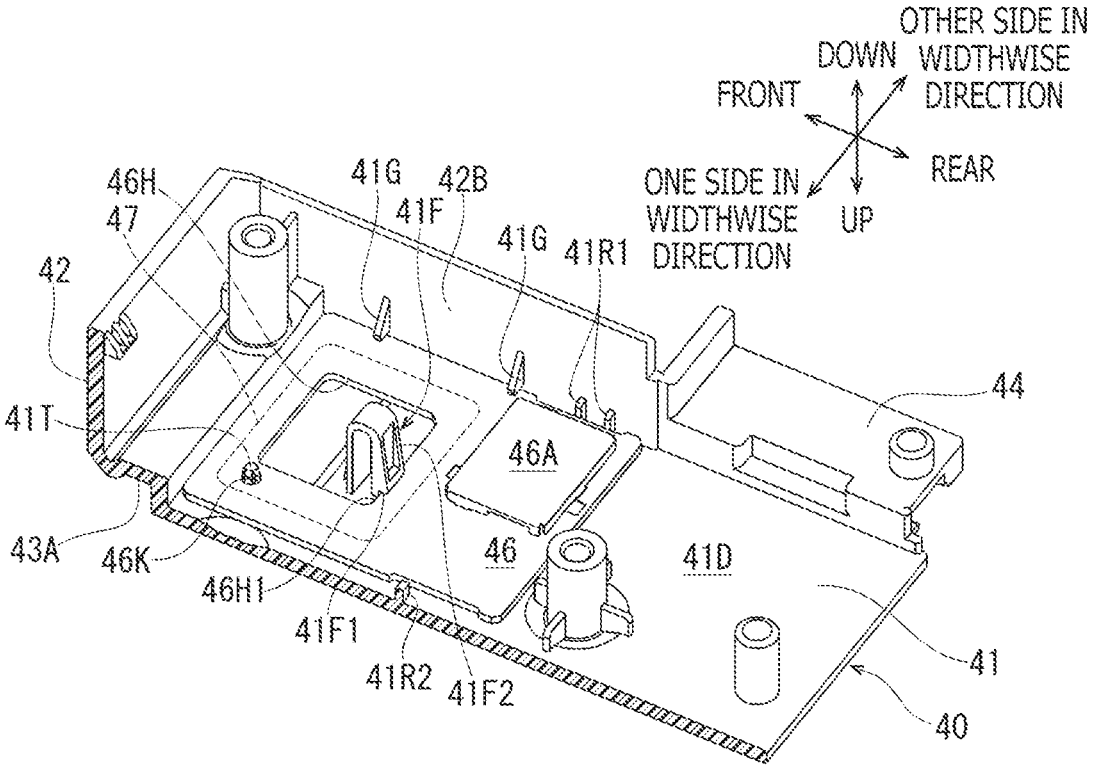
FIG. 8 is a perspective view of the near-field wireless communication board and the external-memory connector board including a section A-A indicated in FIG. 7.

As shown in FIG. 8, the near-field wireless communication board 46 has a form of a substantially rectangular plate and has a board opening 46H and a positioning hole 46K. The board opening 46H is a rectangular hole located on an inner periphery of the antenna circuit 47. The positioning hole 46K is a round hole located adjacent to the board opening 46H on the inner periphery of the antenna circuit 47.

The second cover 40 has locking claws 41G, a positioning protrusion 41T, positioning ribs 41R1, 41R2, and a snap-fit 41F integrally on the lower surface 41D of the second-cover body 41.

The locking claws 41G are protrusions protruding from the side wall 42B toward the one side in the widthwise direction. The locking claws 41G are separated downward from the lower surface 41D of the second-cover body 41 by an amount substantially equal to a thickness of the near-field wireless communication board 46. The locking claws 41G may lock the near-field wireless communication board 46 at an edge on the other side in the widthwise direction in order to restrain the near-field wireless communication board 46 from separating from the lower surface 41D of the second-cover body 41.

The positioning protrusion 41T has a substantially cylindrical form that protrudes downward from the lower surface 41D of the second-cover body 41. The positioning ribs 41R1 are protrusions located rearward apart from the locking claws 41G and protrude sideward from the side wall 42B toward the one side in the widthwise direction. The positioning rib 41R2 is a protrusion located rearward apart from the positioning protrusion 41T and protrudes downward from the lower surface 41D of the second-cover body 41.

The positioning protrusion 41T is fitted into the positioning hole 46K in the near-field wireless communication board 46 that abuts on the lower surface 41D of the second-cover body 41. The positioning ribs 41R1 abut on an edge of the near-field wireless communication board 46 on the other side in the widthwise direction. The positioning rib 41R2 abuts on an edge of the near-field wireless communication board 46 on the one side in the widthwise direction. In this arrangement, the positioning protrusion 41T and the positioning ribs 41R1, 41R2 may locate the near-field wireless communication board 46 at a predetermined position with respect to the second-cover body 41.

The snap-fit 41F protrudes downward from the lower surface 41D of the second-cover body 41 at a position coincident with the board opening 46H in the near-field wireless communication board 46 and is folded rearward.

The snap-fit 41F has an engageable recess 41F1 at an upper end of the folded portion. The engageable recess 41F1 forms a gap which separates the snap-fit 41F from the lower surface 41D and is engageable with an opening edge 46H1 of the board opening 46H. A rear face of the folded portion of the snap-fit 41F forms an oblique surface 41F2, which inclines upper-rearward.

The snap-fit 41F allows the near-field wireless communication board 46 to approach the lower surface 41D of the second-cover body 41 by allowing the folded portion to move away from the opening edge 46H1 as the opening edge 46H1 of the board opening 46H slides on the oblique surface 41F2.

When the near-field wireless communication board 46 is stopped by the lower surface 41D of the second-cover body 41, the oblique surface 41F2 may separate from the opening edge 46H1, the folded portion may move back to the original posture, and the engageable recess 41F1 may engage with the opening edge 46H1. Thus, the snap-fit 41F may restrict the near-field wireless communication board 46 from falling off or separating from the second cover 40.

As shown in FIG. 7, the external-memory connector board 48 is located between the near-field wireless communication board 46 and the second-cover side wall 42A in the widthwise direction and screwed to the lower surface 41D of the second-cover body 41. The connector 48C protrudes from the external-memory connector board 48 toward the one side in the widthwise direction.

The second-cover side wall 42A has a connector opening 42H. As shown in FIG. 6, the connector opening 42H is a rectangular hole, through which an end of the connector 48C penetrates, so that the external memory 49M may be inserted in the penetrated end of the connector 48C. The second groove 43B is formed above the connector opening 42H in the second-cover side wall 42A.

As shown in FIG. 3, the side wall 63 of the upper side cover 64 has a connector opening 63H. The connector opening 63H is a rectangular hole, through which the end of the connector 48C is exposed, and the external memory 49M is allowed to be inserted in the exposed end of the connector 48C through the connector opening 63H.

<Front Cover>

Figure 9:
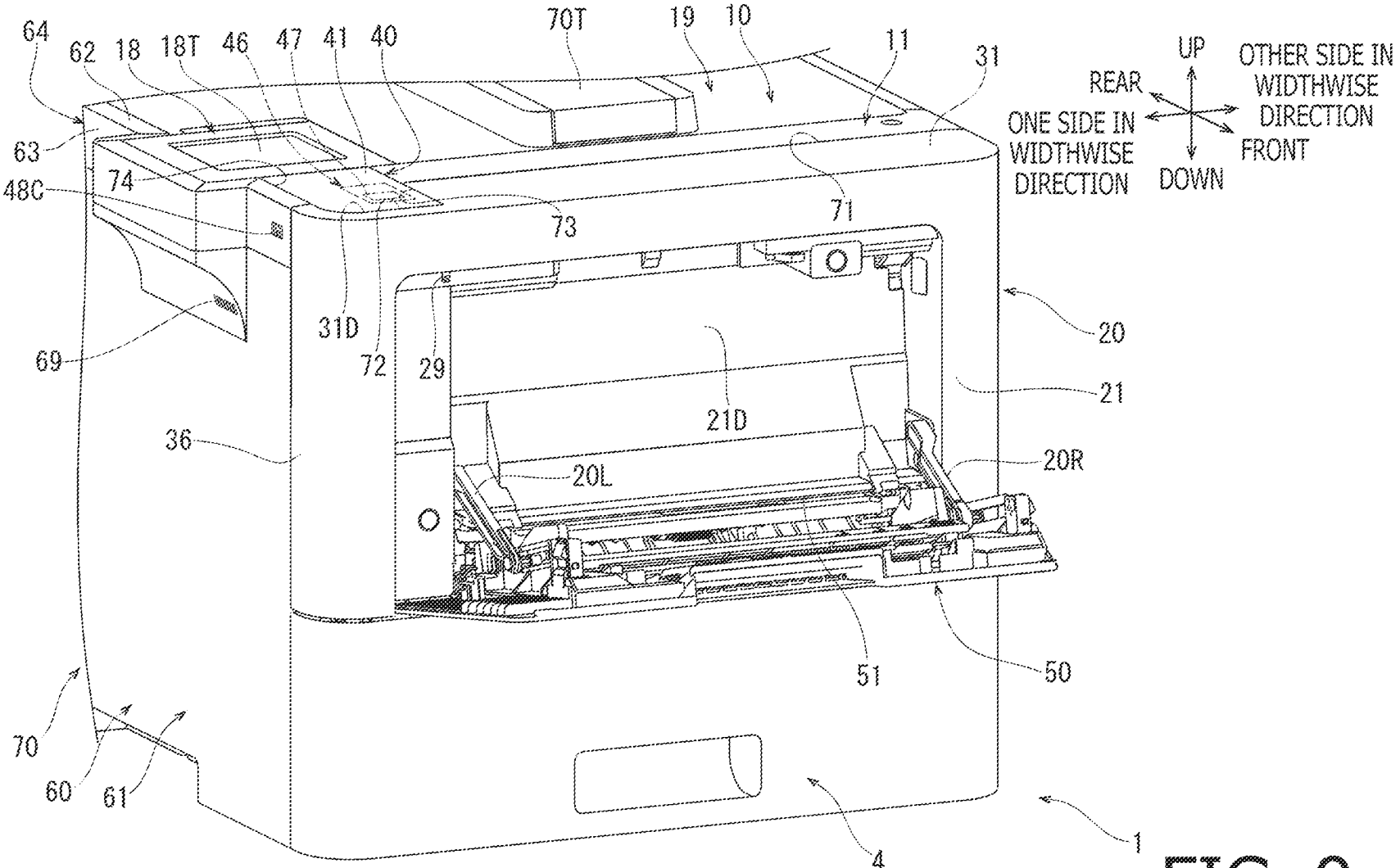
FIG. 9 is a perspective partial view of the image forming apparatus with the sub cover located at a second position.

As shown in FIGS. 1 and 2, the front cover 20 has a front wall 21, a first upper wall 31, and a second side wall 36 integrally. The front cover 20 includes, as shown in FIGS. 1 and 9, a sub cover 50, which is a piece separate from the front wall 21, the first upper wall 31, and the second side wall 36. The sub cover 50 may be formed by injection molding of thermoplastic resin.

As shown in FIG. 2, the first housing 70 is located at a front side of the image forming device 5 and has a first arm 78 and a second arm 79.

The first arm 78 connects the side frame 76L and a widthwise end of the front cover 20 located on the one side in the widthwise direction. The second arm 79 connects the side frame 76R and a widthwise end of the front cover 20 located on the other side in the widthwise direction.

In this arrangement, the side frames 76L, 76R support the front cover 20 movably between a third position, which is shown in FIGS. 1 and 9-12, and a fourth position, which is shown in FIGS. 2 and 3.

The first housing 70 has a stopper, which is not shown but is located on a side of the side frame 76R toward the other side in the widthwise direction. The second arm 79 may locate the front cover 20 at the fourth position as shown in FIG. 2 by abutting on the stopper.

The image forming device 5 has link members 5R, 5S, which are coupled with the first arm 78. The first arm 78 being movable in conjunction with the front cover 20 may switch states of the image forming device 5 through the link members 5R, 5S. For example, the first arm 78 may switch connection and disconnection of a clutch assembly in the image forming device 5 through the link members 5R, 5S.

In the following paragraphs, the form of the front cover 20 may be described with reference to the front-rear direction and the vertical direction, which are based on the posture of the front cover 20 located at the third position.

As shown in FIG. 9, the front wall 21 of the front cover 20 has a sub-cover accommodative portion 21D, which is recessed rearward, at a center in a substantially rectangular plate part spreading in the front-rear direction and the vertical direction.

The front wall 21 has an insertion opening 51 at a position below the sub-cover accommodative portion 21D. The insertion opening 51 is a substantially rectangular opening, of which bottom side is open, and is formed through the front wall 21 in the front-rear direction.

The insertion opening 51 is formed for inserting a sheet for image forming, i.e., a sheet on which an image is to be formed, toward the image forming device 5. The sheet to be inserted may be different in size and/or thickness from the sheet that may be stored in the sheet tray 4. A dimension of the insertion opening 51 in the widthwise direction is larger than a width of the sheet for image forming.

Figure 11:
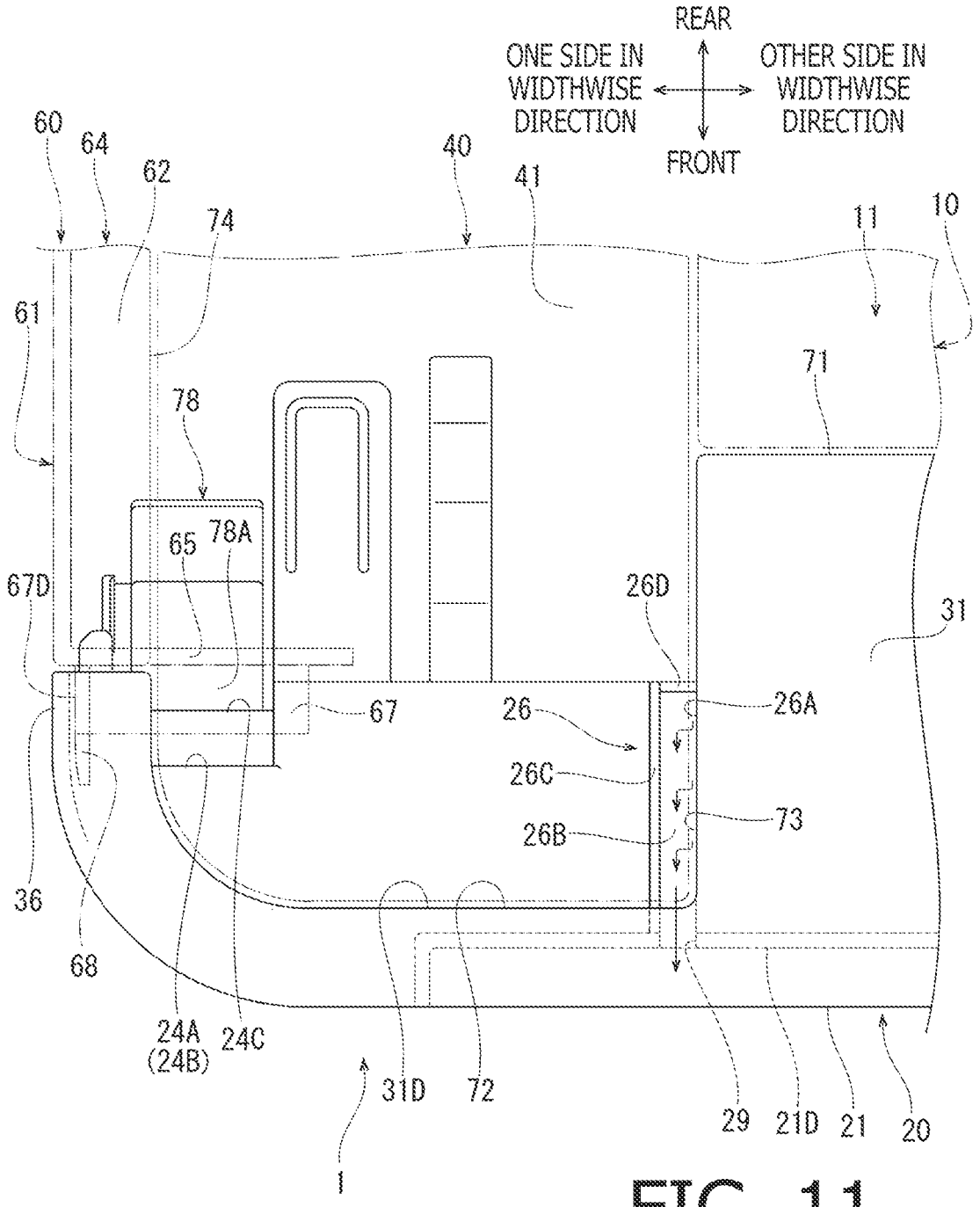
FIG. 11 is a partial top plan view of the image forming apparatus, illustrating relative positions among a second-cover body, first through fourth sections, a first guide, a first outlet port, a first arm, a first rib, and a second drib when the front cover is located at the third position.

As shown in FIGS. 1 and 11, the first upper wall 31 extends rearward from an upper edge of the front wall 21 substantially in a form of a plate elongated in the widthwise direction. The first upper wall 31 has a recess 31D. The recess 31D is recessed frontward from a rearward edge of the first upper wall 31 and may accept a frontward part of the second cover 40.

The first upper wall 31 is arranged alongside the first cover 11 and the second cover 40 being parts of the top cover 10 at least in the front-rear direction. The first upper wall 31 has a first section 71, a second section 72, and a third section 73.

The first section 71 is a rearward end of the first upper wall 31 located on a widthwise side of the recess 31D toward the other side in the widthwise direction. The second section 72 is a frontward edge of the recess 31D and a curved edge located on a widthwise side of the frontward edge toward the one side in the widthwise direction. The third section 73 is a widthwise edge of the recess 31D on the one side in the widthwise direction.

The second side wall 36 extends rearward from a widthwise end of the front wall 21 located on the one side in the widthwise direction substantially in a form of a plate elongated in the vertical direction.

Figure 12:
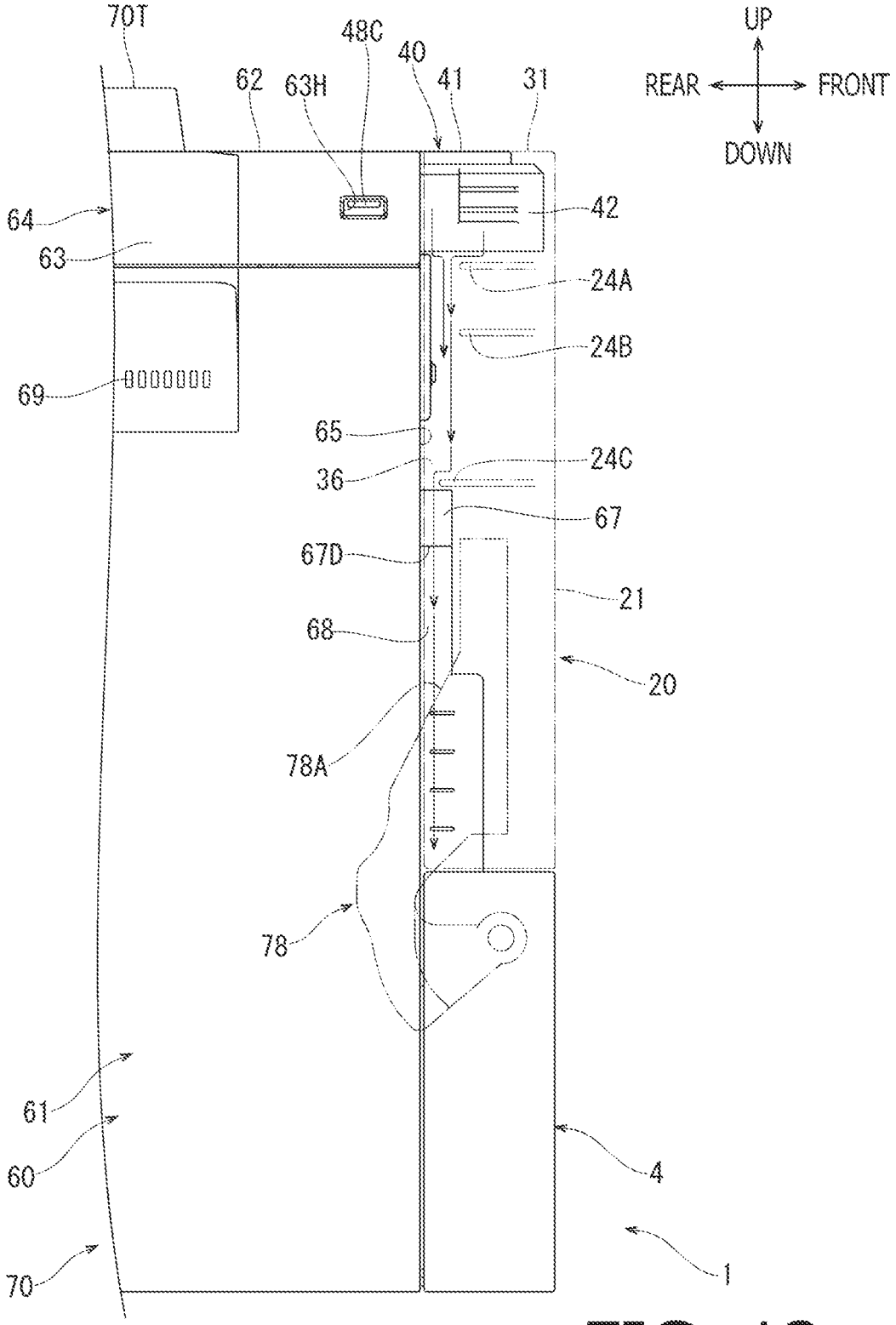
FIG. 12 is a sideward partial view of the image forming apparatus, illustrating relative positions among a second side wall, a facing portion, the first arm, the first rib, and the second rib when the front cover is located at the third position.

As shown in FIG. 1, under the condition where the front cover 20 is at the third position, the front wall 21 stands upright to cover the image forming device 5 from the front side. The first upper wall 31 extends toward the top cover 10 and covers the image forming device 5 from above together with the top cover 10. The second side wall 36 extends toward the frontward end of the side-cover body 61 and the frontward end of the upper side cover 64 and covers the image forming device 5 on the one side in the widthwise direction together with the side-cover body 61 and the side wall 63 of the upper side cover 64. As shown in FIGS. 11 and 12, the second side wall 36 faces the facing portion 65 in the front-rear direction.

Meanwhile, the front cover 20 may, under the condition where the front cover 20 is located at the fourth position, as shown in FIG. 2, extend frontward to the frontward position with respect to the front cover 20 located at the third position. In this arrangement, the front wall 21 and the first upper wall 31 may expose a part of the image forming device 5, in particular, a front face of the drawer unit 5A.

As shown in FIGS. 1 and 11, under the condition where the front cover 20 is located at the third position, the first section 71 is arranged alongside the frontward end of the first cover 11 in the front-rear direction and covers the third guide 16 from above. In this arrangement, therefore, the third guide 16 is located below the first section 71.

Moreover, under the condition where the front cover 20 is located at the third position, the second section 72 is arranged alongside a frontward end of the second-cover body 41 and the rounded corner of the second-cover body 41 at least in the front-rear direction and covers the frontward part of the peripheral wall 42 and the first groove 43A from above. In this arrangement, therefore, the first groove 43A is located below the second section 72.

Moreover, under the condition where the front cover 20 is located at the third position, the third section 73 located between the first section 71 and the second section 72 is arranged alongside a widthwise edge of the second-cover body 41 on the other side in the widthwise direction.

As shown in FIG. 9, the front cover 20 swingably supports the sub cover 50, which is in the form of the substantially rectangular plate, at corners located closer to the sheet tray 4. Moreover, the front cover 20 has a pair of link levers 20L, 20R.

The link levers 20L, 20R couples an inner wall of the sub-cover accommodative portion 21D located on the one side and the other side in the widthwise direction and widthwise edges of the sub cover 50 located on the one side and the other side in the widthwise direction. In this arrangement, the sub cover 50 is movable between a first position, as shown in FIG. 1, and a second position, as shown in FIG. 9.

As shown in FIG. 1, the sub cover 50 is, under the condition where the sub cover 50 is located at the first position, accommodated in the sub-cover accommodative portion 21D in an upright posture and covers the sub-cover accommodative portion 21D including the insertion opening 51 substantially entirely from the front side. In this condition, a frontward face of the sub cover 50, together with a frontward face of the front wall 21, forms a frontward exterior face of the first housing 70.

Meanwhile, the sub cover 50 may, under the condition where the sub cover 50 is located at the second position, as shown in FIG. 9, extend frontward and open the insertion opening 51. In this posture, an upward face of the sub cover 50 may support the sheet to be inserted in the insertion opening 51 toward the image forming device 5. In other words, the sub cover 50 may serve as a multipurpose tray or a manual-feeder tray.

<First Guide and First Outlet Port>

Figure 10:
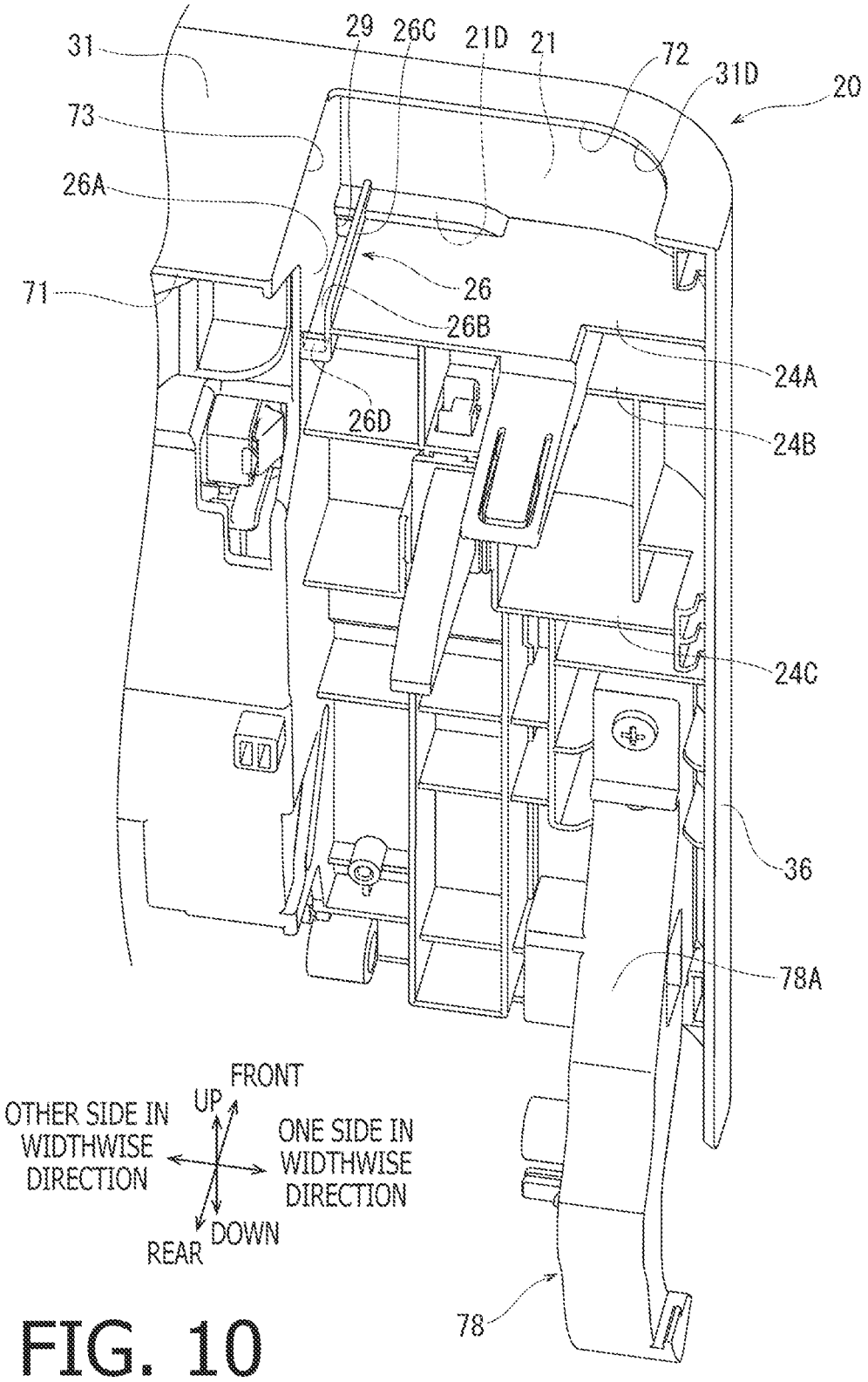
FIG. 10 is a perspective partial view of the front cover located at the third position.

As shown in FIGS. 10 and 11, the front cover 20 has a first guide 26 on a rearward side of the front wall 21 in a neighboring area to the recess 31D of the first upper wall 31. The first guide 26 has a first vertical rib 26A, a bottom rib 26B, a second vertical rib 26C, and a partition rib 26D.

The first vertical rib 26A extends downward from the third section 73 of the first upper wall 31 and extends longitudinally in the front-rear direction. A front end of the first vertical rib 26A is connected to a rearward surface of the front wall 21 and a rearward surface of the sub-cover accommodative portion 21D.

The bottom rib 26B is located at a lower and separated position from the third section 73. The bottom rib 26B is connected to a surface of the first vertical rib 26A that faces toward the one side in the widthwise direction and extends shorter in the widthwise direction and longer in the front-rear direction. A frontward end of the bottom rib 26B is connected to the rearward surface of the sub-cover accommodative portion 21D. An upward surface of the bottom rib 26B may be a horizontal plane or, optionally, may incline moderately lower-frontward.

The second vertical rib 26C is connected to an edge of the bottom rib 26B, which is separated from the first vertical rib 26A toward the one side in the widthwise direction. The second vertical rib 26C protrudes upward and extends longitudinally in the front-rear direction. A frontward end of the second vertical rib 26C is connected to the rearward surface of the sub-cover accommodative portion 21D. An upper end of the second vertical rib 26C is located to be higher than an upper end of the sub-cover accommodative portion 21D.

The partition rib 26D protrudes upward from a rearward end of the bottom rib 26B and extends in the widthwise direction to connect to a lower part of a rearward end of the first vertical rib 26A and a lower part of a rearward end of the second vertical rib 26C.

With the first vertical rib 26A, the bottom rib 26B, and the second vertical rib 26C, the first guide 26 forms a groove extending in the front-rear direction and having substantially a cross-sectional shape of "J" in a view along the front-rear direction. The partition rib 26D closes a rearward end of the groove of the first guide 26.

The first guide 26 is located below the third section 73 and extends in the front-rear direction to connect to the front wall 21. One end of the first groove 43A is located above the first guide 26.

As shown in FIG. 9, the front wall 21 has a first outlet port 29 in a neighboring area to an inner upper wall of the sub-cover accommodative portion 21D at a position toward the one side in the widthwise direction. The insertion opening 51 is located at a position separated from the first outlet port 29 toward the other side in the widthwise direction.

As shown in FIGS. 10 and 11, the first outlet port 29 is formed through the sub-cover accommodative portion 21D of the front wall 21 in the front-rear direction. A frontward end of the first guide 26 is connected to the first outlet port 29. The first guide 26 may guide the liquid entering the first housing 70 from the outside through the gap between the third section 73 and the second-cover body 41 to the first outlet port 29. Moreover, the first guide 26 may guide the liquid flowing down from the one end of the first groove 43A to the first outlet port 29.

The first outlet port 29 may discharge the liquid guided to the first guide 26 frontward, i.e., on a frontward side of the sub-cover accommodative portion 21D.

The sub cover 50 covers, when located at the first position as shown in FIG. 1, the first outlet port 29 from the front side. On the other hand, when located at the second position as shown in FIG. 9, the sub cover 50 opens the first outlet port 29.

<First Rib and Second Rib>

As shown in FIG. 3, the side-cover body 61 has a first rib 67 and a second rib 68 at lower positions in the second cover 40.

The first rib 67 protrudes frontward from the facing portion 65, inclining to be lower toward the one side in the widthwise direction. The second rib 68 protrudes frontward from the facing portion 65, extending longitudinally downward from a lower end 67D of the first rib 67.

As shown in FIG. 11, when the front cover 20 is located at the third position, the lower end 67D of the first rib 67 and the second rib 68 are arranged alongside a rearward end of the second side wall 36 on the other side in the widthwise direction.

As shown in FIGS. 11 and 12, when the front cover 20 is located at the third position, the first rib 67 covers an oblique surface 78A of the first arm 78, which inclines lower-rearward, from above.

As shown in FIG. 10, the front cover 20 has a first transverse rib 24A, a second transverse rib 24B, and a third transverse rib 24C, which align in this given order from up to down, on the rearward side of the front wall 21 and in a sideward area on the one side in the widthwise direction.

As shown in FIGS. 11 and 12, when the front cover 20 is located at the third position, the first transverse rib 24A, the second transverse rib 24B, and the third transverse rib 24C are located at upper positions with respect to the first arm 78.

Rearward ends of the first transverse rib 24A and the second transverse rib 24B are located frontward with respect to a rearward end of the third transverse rib 24C. In this arrangement, the facing portion 65 of the side-cover body 61 and the rear ends of the first transverse rib 24A and the second transverse rib 24B are substantially separated. Therefore, when the liquid enters the first housing 70 through a position higher than the facing portion 65 of the side-cover body 61, the liquid may flow downward without spreading on the first transverse rib 24A or the second transverse rib 24B.

The rearward end of the third transverse rib 24C is located rearward with respect to a frontward end of the first rib 67. Therefore, the third transverse rib 24C may guide the liquid flowing down through the first transverse rib 24A and the second transverse rib 24B to the first rib 67, and the first rib 67 and the second rib 68 may guide the liquid downward and toward the one side in the widthwise direction. Therefore, the liquid may be restrained from flowing on the oblique surface 78A of the first arm 78.

<Second Guide and Second Outlet Port>

As shown in FIGS. 5 and 6, the side cover 60 has a second outlet port 69 and a second guide 66.

The second outlet port 69 is located at a lower end of the part of the side-cover body 61 bulging outward, on the one side in the widthwise direction, corresponding to the part of the touch panel 18 that protrudes outward on the one side in the widthwise direction. The second outlet port 69 includes a plurality of holes that align in the front-rear direction and are formed through the side-cover body 61. The second guide 66 has an upstream guide 66U and a downstream guide 66D.

The upstream guide 66U includes a fitting protrusion 66UI as shown in FIG. 5 and a fitting recess 66U2 as shown in FIG. 6.

As shown in FIG. 5, the fitting protrusion 66U1 protrudes from an inner side of the upper side cover 64 toward the other side in the widthwise direction and extends downward to a lower position with respect to a lower end of the upper side cover 64.

As shown in FIG. 6, the fitting recess 66U2 is located rearward with respect to the connector opening 42H in the second-cover side wall 42A of the second cover 40. The fitting recess 66U2 is recessed from an outer surface of the second-cover side wall 42A toward the other side in the widthwise direction and extends longitudinally in the vertical direction. Although not illustrated in the drawings, the fitting recess 66U2 may fit with an upper part of the fitting protrusion 66U1.

An upper end of the fitting recess 66U2 is connected to the second groove 43B at a position in vicinity to the other end 43B1 of the second groove 43B. In other words, the other end 43B1 of the second groove 43B is located above the second guide 66. The upstream guide 66U is connected with the second groove 43B and may guide the liquid flowing in the first groove 43A and the second groove 43B downward.

The downstream guide 66D includes a first oblique plate 66D1, which is shown in FIGS. 5 and 6, and a second oblique plate 66D2, which is shown in FIG. 5.

As shown in FIG. 5, the first oblique plate 66D1 inclines to be higher toward the other side in the widthwise direction from a position adjacent to a lower end of the second outlet port 69 and extends in the front-rear direction in a form of a plate.

The first oblique plate 66D1 has a rib, which rises upward from a rearward end, a widthwise end on the other side in the widthwise direction, and a frontward end thereof. The rib on the rearward end of the first oblique plate 66D1 is connected to an inner surface of the side-cover body 61. The rib on the frontward end of the first oblique plate 66D1 is separated from the inner surface of the side-cover body 61.

The second oblique plate 66D2 extends from a position below a lower end of the fitting protrusion 66U1 on the inner surface of the side-cover body 61 toward the other side in the widthwise direction and extends to incline lower-rearward in a form of a plate. A rearward end of the second oblique plate 66D2 is connected to the frontward end of the first oblique plate 66D1.

The second oblique plate 66D2 has a rib, which rises upward from an edge of the second oblique plate 66D2 on the other side in the widthwise direction.

The downstream guide 66D is connected with the upstream guide 66U through the second oblique plate 66D2 and may guide the liquid flowing from the upstream guide 66U lower-rearward. Thus, the downstream guide 66D may guide the liquid through the first oblique plate 66D1, which connects to the second outlet port 69, to the second outlet port 69.

As shown in FIG. 6, the second guide 66 may guide the liquid entering the first housing 70 from the outside through the gap between the second section 72 and the second-cover body 41 and the gap between the fourth section 74 and the second-cover body 41 and flowing through the first groove 43A and the second groove 43B to the second outlet port 69.

The second outlet port 69 may discharge the liquid guided by the second guide 66 to the one side in the widthwise direction, i.e., to the outer side of the side-cover body 61.

<Third Guide>

As shown in FIG. 4, the third guide 16 may receive the liquid entering the first housing 70 from the outside through the gap between the first section 71 and the first cover 11 to the other side in the widthwise direction.

The first housing 70 has a side-cover body 61R, which covers the image forming device 5 on the other side in the widthwise direction. The side-cover body 61R is paired with the side-cover body 61.

Figure 13:
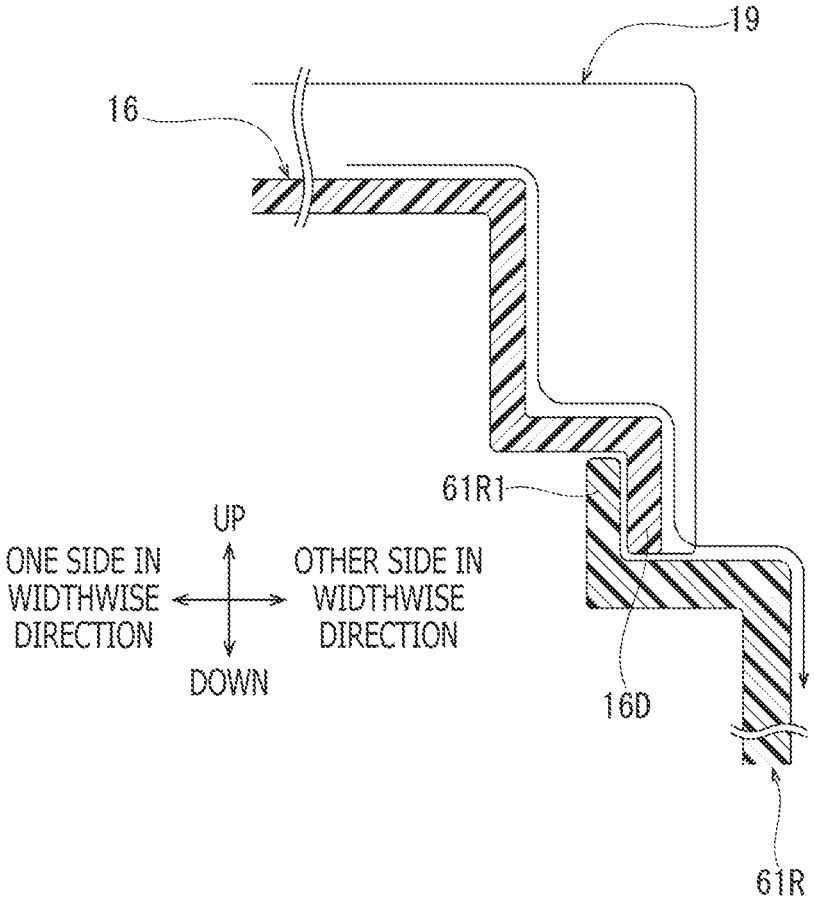
FIG. 13 is a cross-sectional partial view of the second cover and the neighboring area, with the first cover being removed, sectioned at a line B-B indicated in FIG. 4.

As shown in FIG. 13, an upper part of the side-cover body 61R extends outward toward the other side in the widthwise direction and has a rib 61R1, which extends further upward from a widthwise end of the side-cover body 61R on the one side in the widthwise direction.

Meanwhile, a widthwise end of the third guide 16 on the other side in the widthwise direction is located above an upper end of the side-cover body 61R and protrudes downward. A lower end 16D of the third guide 16 is arranged alongside the rib 61R1 on the other side in the widthwise direction.

The widthwise end of the third guide 16 on the other side in the widthwise direction may guide the liquid, which is guided by the third guide 16 to the other side in the widthwise direction, downward and allow the liquid to flow down on the upper part of the side-cover body 61R on a side opposite to the rib 61R1 on the other side in the widthwise direction. Accordingly, the liquid may flow down along the side-cover body 61R on the outside of the first housing 70.

<Fourth Guide and Guiding Protrusion>

As shown in FIG. 6, the side frame 76L has a fourth guide 76L1. While FIG. 6 shows solely one of widthwise ends of the fourth guide 76L1, the fourth guide 76L1 is a groove, which is dented in a form of a downward arc in a cross-sectional view and extends in the widthwise direction.

One of the widthwise ends of the fourth guide 76L1 on the one side in the widthwise direction is located above the first oblique plate 66D1. Meanwhile, although not shown in the drawings, the other of the widthwise ends of the fourth guide 76L1 on the other side in the widthwise direction is located below a rearward end of the guiding protrusion 44 of the second cover 40.

The guiding protrusion 44 may guide the liquid entering the first housing 70 from the outside through the gap between the widthwise end of the first cover 11 on the one side in the widthwise direction and the second-cover body 41 rearward and allow the liquid to flow to the widthwise end of the fourth guide 76L1 on the other side in the widthwise direction.

The fourth guide 76L1 may guide the liquid received from the guiding protrusion 44 toward the one side in the widthwise direction to fall on the first oblique plate 66D1. Accordingly, the second outlet port 69 may discharge the liquid flowing from the fourth guide 76L1 to the first oblique plate 66D1 toward the one side in the widthwise direction, i.e., to the outer side of the side-cover body 61.

<Benefits>

In the image forming apparatus 1 according to the first embodiment described above, when, for example, liquid such as water is spilled over the first housing 70, the liquid may flow on the first cover 11 and/or the second cover 40 of the top cover 10, on the first upper wall 31 of the front cover 20, and/or on the second upper wall 62 of the upper side cover 64. In such cases, the liquid may enter the first housing 70 through the gap between the first cover 11 and the first upper wall 31, the gap between the second cover 40 and the first upper wall 31, and/or the gap between the second cover 40 and the second upper wall 62.

In this regard, as shown in FIG. 10, the first guide 26 including the first vertical rib 26A, the bottom rib 26B, and the second vertical rib 26C has the form of the groove. Moreover, the partition rib 26D closes the rearward end of the first guide 26 being the groove.

Moreover, as shown in FIG. 11, the first guide 26 is located below the third section 73 of the first upper wall 31, extending in the front-rear direction, to connect to the front wall 21. The first guide 26 may guide the liquid entering the first housing 70 from the outside through the gap between the third section 73 and the second-cover body 41 to the first outlet port 29.

In particular, the liquid entering the first housing 70 through the gap between the third section 73 and the second-cover body 41 may flow down along the first vertical rib 26A and pool on the bottom rib 26B. While the liquid may be restrained from moving rearward or toward the one side in the widthwise direction by the second vertical rib 26C, the liquid may be guided frontward by the bottom rib 26B to the first outlet port 29.

The first outlet port 29 may guide the liquid frontward with respect to the sub-cover accommodative portion 21D of the front wall 21 and discharge the liquid outward. Accordingly, the liquid may flow down along the front wall 21 of the front cover 20 on the outside of the first housing 70.

Moreover, as shown in FIGS. 5 and 6, the second guide 66 has the upstream guide 66U and the downstream guide 66D. The liquid entering the first housing 70 through the gap between the second section 72 of the first upper wall 31 and the second-cover body 41 and the gap between the fourth section 74 of the second upper wall 62 and the second-cover body 41 may pool in the first groove 43A and the second groove 43B.

The upstream guide 66U may guide the liquid pooled in the first groove 43A and the second groove 43B downward along the fitting protrusion 66U1 and the fitting recess 66U2. The downstream guide 66D may guide the liquid flowing down from the upstream guide 66U to the second outlet port 69 along the first oblique plate 66D1 and the second oblique plate 66D2.

The second outlet port 69 may guide the liquid toward the one side in the widthwise direction with respect to the side-cover body 61 and discharge the liquid outward.

Accordingly, the liquid may flow down along the side-cover body 61 on the outside of the first housing 70.

Moreover, as shown in FIG. 4, the third guide 16 may receive the liquid entering the first housing 70 from the outside through the gap between the first section 71 of the first upper wall 31 and the frontward end of the first cover 11 and guide the liquid toward the other side in the widthwise direction.

As shown in FIG. 13, the sideward part of the third guide 16 on the other side in the widthwise direction may guide the liquid guided by the third guide 16 to the other side in the widthwise direction downward and allows the liquid to flow on the upper part of the side-cover body 61R on the side of the rib 61R1 of the side-cover body 61R toward the other side in the widthwise direction. Accordingly, the liquid may flow down along the side-cover body 61R on the outside of the first housing 70.

Moreover, as shown in FIG. 6, the guiding protrusion 44 may guide the liquid entering the first housing 70 from the outside through the gap between the widthwise end of the first cover 11 on the one side in the widthwise direction and the second-cover body 41 rearward and allow the liquid to flow to the fourth guide 76L1. The fourth guide 76L1 may guide the liquid received from the guiding protrusion 44 toward the one side in the widthwise direction to flow on the first oblique plate 66D1. Accordingly, the second outlet port 69 may discharge the liquid flowing from the fourth guide 76L1 to the first oblique plate 66D1 toward the one side in the widthwise direction, i.e., to the outer side of the side-cover body 61.

Thus, the image forming apparatus 1 in the first embodiment described above may restrict the liquid entering the first housing 70 from staying inside the first housing 70 but discharge the liquid to the outside reliably. Therefore, the image forming apparatus 1 may restrain deficiency due to the liquid staying inside the first housing 70 reliably.

Moreover, the image forming apparatus 1 has the front cover 20 having the sub cover 50 that covers the first outlet port 29 on the front side. Therefore, exterior appearance of the image forming apparatus 1 may be restrained from being disturbed by the first outlet port 29.

Moreover, the image forming apparatus 1 has the sub cover 50 that is movable between the first position shown in FIG. 1 and the second position shown in FIG. 9. In other words, the sub cover 50 may serve, not only as a cover, but also as a multipurpose tray or a manual feeder tray. Therefore, compared to an image forming apparatus having a sub cover that covers the first outlet port 29 separately from a multipurpose tray or a manual feeder tray, the image forming apparatus 1 according to the embodiment described above may restrain a quantity of parts from increasing and the exterior appearance from being disturbed.

Moreover, the image forming apparatus 1 has the side-cover body 61 having the facing portion 65, the first rib 67, and the second rib 68, as shown in FIGS. 3 and 12. When the liquid enters the first housing 70 through an area above the facing portion 65 of the side-cover body 61, the first rib 67 may receive the liquid and guide the liquid toward the one side in the widthwise direction and downward, that is, to the gap between the facing portion 65 of the side-cover body 61 and the rearward end of the second side wall 36. The second rib 68 may restrict the liquid flowing along the gap from returning inside first housing 70. Accordingly, the image forming apparatus 1 may restrict the liquid entering the first housing 70 from staying inside and discharge the liquid to the outside reliably.

Moreover, the image forming apparatus 1 has the first rib 67, which covers the oblique surface 78A of the first arm 78 under the condition where the front cover 20 is located at the third position. In this arrangement, when the liquid enters the first housing 70 through the area above the facing portion 65 of the side-cover body 61, the first rib 67 and the second rib 68 may receive the liquid at the positions above the oblique surface 78A of the first arm 78 and guide the liquid to separate away from the first arm 78. Accordingly, the image forming apparatus 1 may restrain the liquid entering the first housing 70 from flowing lower-rearward along the oblique surface 78A of the first arm 78 to proceed further inside the first housing 70.

Moreover, the image forming apparatus 1 has, as shown in FIG. 1, the top cover 10 having the first cover 11 and the second cover 40. Meanwhile, the first upper wall 31 has the first section 71, the second section 72, and the third section 73. The second upper wall 62 has the fourth section 74. In other words, the upper face of the first housing 70 has a number of gaps, through which the liquid may enter the first housing 70 from the outside. Therefore, the image forming apparatus 1 may reap the benefits achievable through the first outlet port 29, the second guide 66, and the second outlet port 69 more effectively.

Moreover, the image forming apparatus 1 has the front cover 20, which has the first guide 26 and the first outlet port 29, as shown in FIG. 10. Therefore, the first guide 26 and the first outlet port 29 are connected without a gap therebetween.

Moreover, in the image forming apparatus 1, as shown in FIG. 6, the one end of the first groove 43A is located above the first guide 26, and the other end 43B1 of the second groove 43B is located above the second guide 66. Therefore, the first guide 26 and the second guide 66 may receive the liquid flowing from the first groove 43A and the second groove 43B reliably.

Moreover, as shown in FIGS. 5 and 6, the image forming apparatus 1 has the second guide 66, which has the upstream guide 66U and the downstream guide 66D. Therefore, the liquid pooled in the first groove 43A and the second groove 43B may be guided to the second outlet port 69 reliably, and the liquid flowing from the guiding protrusion 44 may be guided to the second outlet port 69 through the fourth guide 76L1 reliably.

Moreover, as shown in FIG. 6, the image forming apparatus 1 has the second groove 43B, which is extended above the connector opening 42H of the second-cover side wall 42A. Therefore, the second groove 43B may guide the liquid to flow away from the connector opening 42H to the first guide 26 or the second guide 66. Accordingly, the liquid may be restrained from deficiency that may be caused by moisturizing the connector 48C.

Moreover, the image forming apparatus 1 has the second cover 40, which has the snap-fit 41F on the lower surface 41D of the second-cover body 41, as shown in FIGS. 7 and 8. The snap-fit 41F is located inside the board opening 46H and restrict the near-field wireless communication board 46 from falling off or separating from the second cover 40. In this arrangement, compared to an arrangement, in which the second cover 40 has a snap-fit engageable with an outer peripheral edge of the near-field wireless communication board 46, the second cover 40 may be downsized.

SECOND EMBODIMENT

Figure 14:
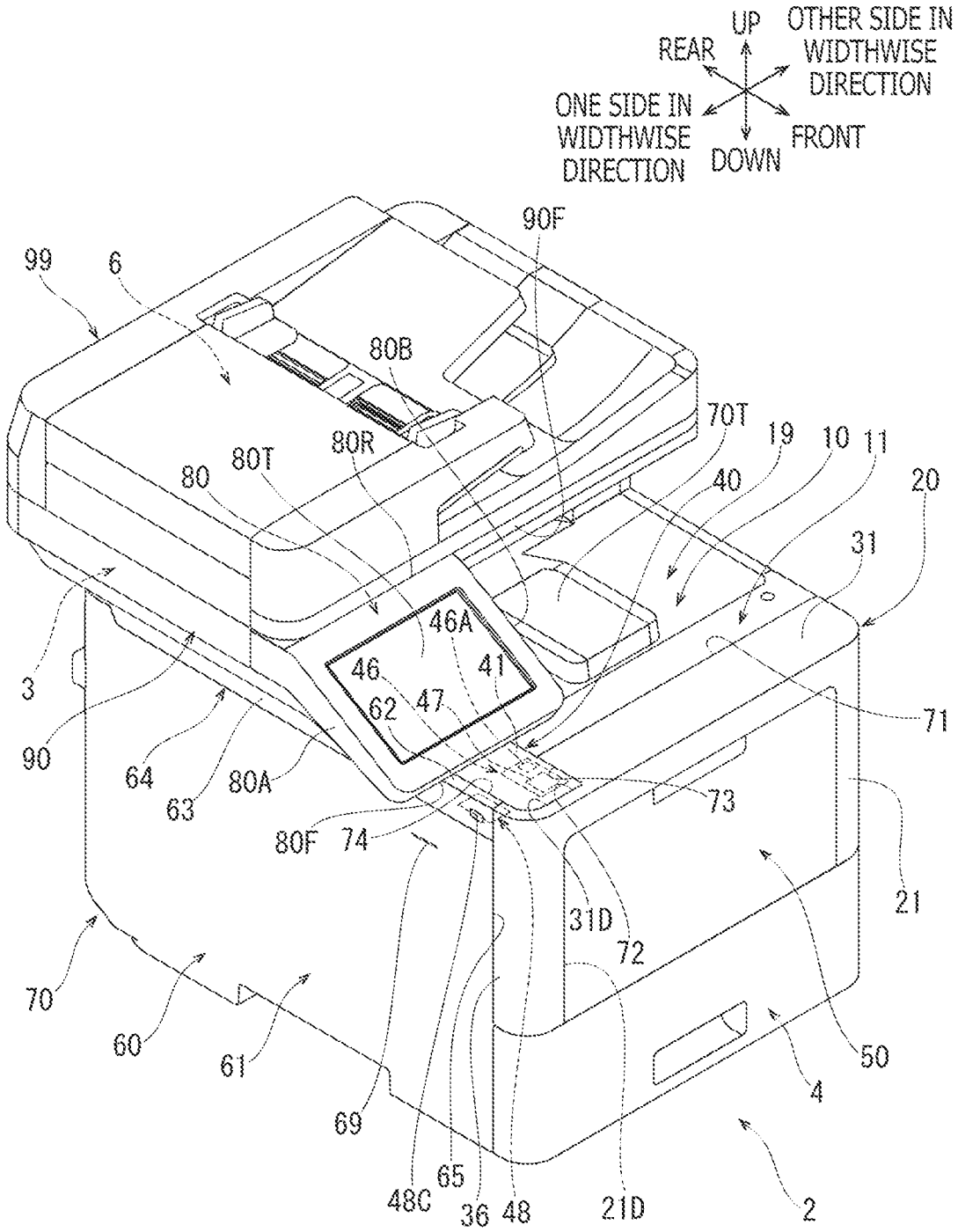
FIG. 14 is a perspective view of another image forming apparatus.

As shown in FIG. 14, an image forming apparatus 2 according to a second embodiment of the present disclosure has neither the covering body 10F nor the touch panel 18 but has a second housing 90, a reader 3, a document cover 99, an auto-document feeder 6, and an operation panel 80.

The remainder of the image forming apparatus 2 in the second embodiment may be substantially identical to the configuration of the image forming apparatus 1 in the first embodiment. Therefore, items in the image forming apparatus 2 that are identical to those in the image forming apparatus 1 may be referred to by the same reference signs, and description of those will be herein omitted or simplified.

The second housing 90 is located to be higher than the first housing 70. The top cover 10 has the top-cover body 19 modified from the top-cover body 19 in the image forming apparatus 1 of the first embodiment so that it may serve also as a joint cover to support the second housing 90. Meanwhile, the first cover 11 and the second cover 40 may be in the same configuration as those in the image forming apparatus 1 of the first embodiment.

The second housing 90 is a so-called flatbed having a reading surface, which is not shown in the drawings, on an upper side thereof. The second housing 90 accommodates the reader 3, which may read an image of an original material placed on the reading surface of the second housing 90.

The document cover 99 is located to be higher than the second housing 90 and may close or open the reading surface. The document cover 99 accommodates the auto-document feeder 6. The auto-document feeder 6 may convey a sheet being a reading object to the reading surface so that the reader 3 may read the image of the sheet being conveyed.

The operation panel 80 protrudes frontward from a frontward end 90F of the second housing 90. The operation panel 80 has an operative surface 80T. The operative surface 80T is an oblique surface, of which frontward edge 80F is lower than a rearward edge 80R thereof. The operative surface 80T may be substantially in the same configuration as the operative surface 18T of the touch panel 18 described in the first embodiment.

Figure 15:
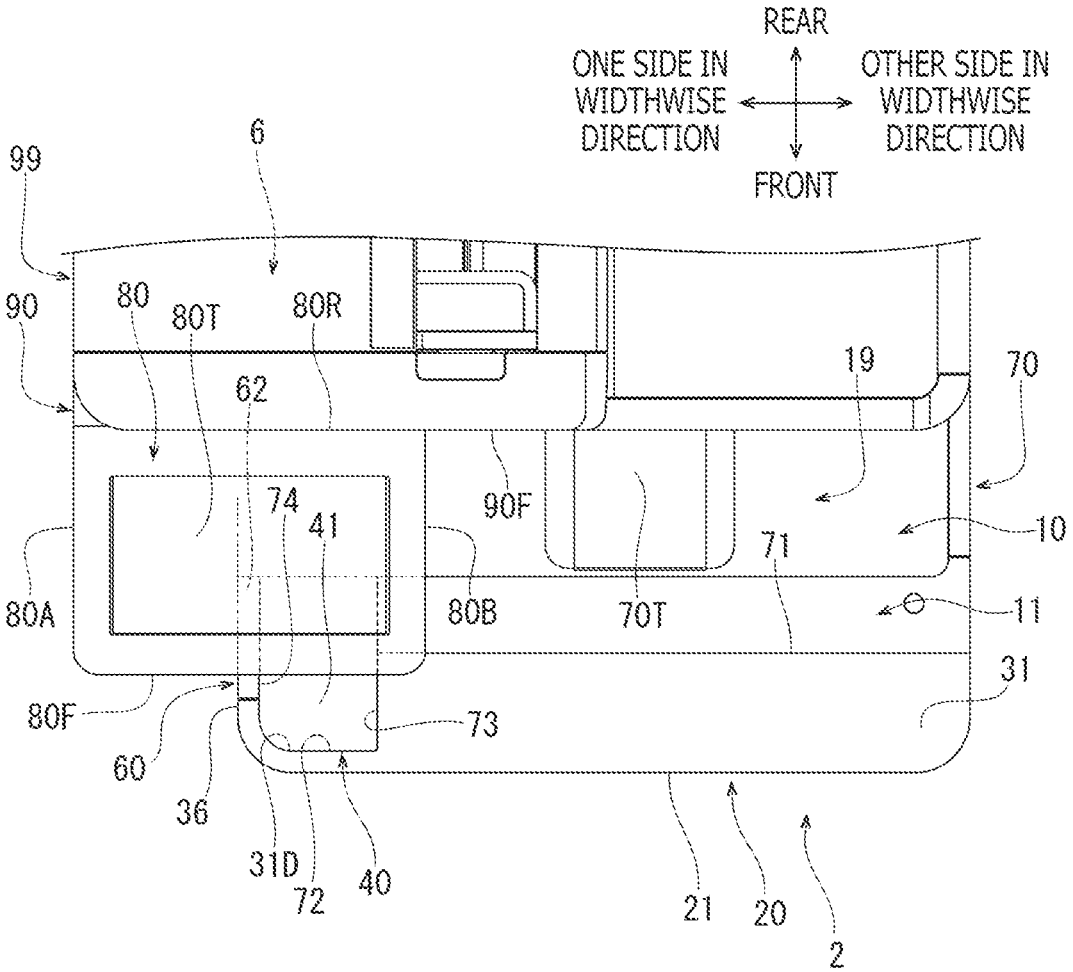
FIG. 15 is a top plan view of the another image forming apparatus.

As shown in FIG. 15, the third section 73 is located between an edge 80A being one of widthwise edges of the operative surface 80T on the one side in the widthwise direction and an edge 80B being the other of the widthwise edges of the operative surface 80T on the other side in the widthwise direction. Moreover, the second section 72 and the fourth section 74 are located between the edge 80A and the edge 80B of the operative surface 80T on the one side and the other side in the widthwise direction.

In the arrangement of the image forming apparatus 2 in the second embodiment, liquid spilled on the second housing 90 and/or the operation panel 80 may tend to flow frontward along the operative surface 80T. Therefore, the liquid may enter the first housing 70 through the gap between the third section 73 and the second-cover body 41 easily. Moreover, the liquid may enter the first housing 70 through the gap between the second section 72 and the second-cover body 41 and the gap between the fourth section 74 and the second-cover body 41 as well.

In this regard, the first guide 26, the first outlet port 29, the second guide 66, and the second outlet port 69 may work as effectively as those in the first embodiment to restrain the liquid entering the first housing 70 from staying inside but discharge the liquid to the outside reliably. Therefore, the image forming apparatus 2 may restrain deficiency that may be caused by the liquid staying inside the first housing 70 reliably.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below.

For example, the first guide 26 may not necessarily be provided in the front cover 20 together with the first outlet port 29, but the first guide may be provided in a different member in the first housing from the front cover, such as, for example, an inner frame in the first housing.

For another example, the second guide 66 may not necessarily be provided in the side cover 60 together with the second outlet port 69, but the second guide may be provided in a different member in the first housing from the side cover, such as, for example, an inner frame in the first housing.

For another example, the first guide 26 may not necessarily be formed to have the cross-sectional shape of "J" in the view along the front-rear direction but may have a form of a groove recessed downward from an upper surface of a transverse rib or a form of a folded rib having a cross-sectional shape of "V" in a view along the front-rear direction.

For another example, the sub cover 50 may not necessarily serve as a multipurpose tray or a manual-feeder tray as long as the sub cover covers at least the first outlet port on the front side. For another example, the sub cover may not necessarily be movable.

For another example, the side cover 60 may not necessarily have the side-cover body 61 and the upper side cover 64 separately, but the side cover 60 may be modified into a form, in which the side-cover body 61 and the upper side cover 64 are integrally formed.

For another example, the top cover 10 may not necessarily have the top-cover body 19, the first cover 11, and the second cover 40, but the top cover 10 may be formed integrally in one piece.

For another example, the front cover 20 may not necessarily be in the configuration, in which the second side wall 36 is located sideward from the second cover 40 of the top cover 10 toward the one side in the widthwise direction aligning with the side cover 60 in the front-rear direction. For example, the side cover 60 may be extended to a position frontward from the second cover 40 and may be bent toward the other side of the widthwise direction at the frontward position so that the side cover 60 may align with the front cover 20 in the widthwise direction and with the second cover 40 in the widthwise and front-rear directions.

For another example, the second cover 40 may not necessarily have the near-field wireless communication board 46 and the external-memory connector board 48, but the second cover 40 may have one of the near-field wireless communication board 46 and the external-memory connector board 48 alone.

The present invention may be applicable in, for example, an image forming apparatus or a multifunction peripheral machine.

What is claimed is:

1. An image forming apparatus, comprising:

an image forming device configured to form an image on a sheet; and a housing accommodating the image forming device, the housing comprising:

a top cover located above the image forming device;

a front cover having:

a front wall having a first outlet port, the front wall being located at a front side of the image forming device; and a first upper wall extending from an upper end of the front wall toward the top cover, the first upper wall being arranged alongside the top cover at least in a front-rear direction;

a side cover having:

a side wall having a second outlet port, the side wall being located at one side of the image forming device in a widthwise direction; and a second upper wall extending from an upper end of the side wall toward the top cover, the second upper wall being arranged alongside the top cover at least in the widthwise direction;

a first guide configured to guide liquid entering the housing from outside to the first outlet port, the first guide being connected to the front wall; and a second guide configured to guide the liquid entering the housing from the outside to the second outlet port, the second guide being connected to the side wall.

2. The image forming apparatus according to claim 1, wherein the front cover has a sub cover configured to cover the first outlet port from the front side.

3. The image forming apparatus according to claim 2, wherein the front wall of the front cover has an insertion opening, through which a sheet is allowed to be inserted toward the image forming device, wherein the insertion opening is separated from the first outlet port in the widthwise direction, and wherein the sub cover is movable between a first position, in which the sub cover covers the insertion opening and the first outlet port from the front side, and a second position, in which the insertion opening and the first outlet port are exposed and in which the sub cover is enabled to support the sheet.

4. The image forming apparatus according to claim 3, wherein said side wall is a first side wall, the front cover having a second side wall, the second side wall extending rearward from a sideward end of the front wall located on the one side in the widthwise direction toward the side cover, wherein the side cover has:

a facing portion facing the second side wall in the front-rear direction;

a first rib protruding frontward from the facing portion, the first rib inclining to be lower toward the one side in the widthwise direction, a lower end of the first rib being arranged alongside the second side wall;

a second rib protruding frontward from the facing portion, the second rib being connected with the lower end of the first rib, the second rib being arranged alongside the second side wall and extending downward.

5. The image forming apparatus according to claim 4, wherein the front cover is movable between a third position, in which the front wall covers the image forming device from the front side, and a fourth position, in which the front wall is located frontward with respect to the front wall when the front cover is located at the third position and in which the image forming device is partly exposed, wherein the housing has an arm connected with the front cover, the arm being movable in conjunction with the front cover, and wherein the first rib covers the arm from above under a condition where the front cover is located at the third position.

6. The image forming apparatus according to claim 1, wherein the top cover has:

a first cover; and a second cover located frontward with respect to the first cover, the second cover being smaller than the first cover in the widthwise direction, the second cover having a near-field wireless communication board including an antenna circuit, by which short-range communication with an external device is enabled, on a lower surface thereof, wherein the first upper wall has:

a first section arranged alongside the first cover in the front-rear direction;

a second section arranged alongside the second cover at least in the front-rear direction; and a third section arranged alongside, at a position between the first section and the second section, the second cover in the widthwise direction, and wherein the second upper wall has a fourth section arranged alongside the second cover in the widthwise direction.

7. The image forming apparatus according to claim 6, wherein the front cover has the first guide below the third section, and wherein the first guide has a form of a groove extending in the front-rear direction.

8. The image forming apparatus according to claim 6, wherein the second cover has:

a first groove located below the second section, the first groove extending in the widthwise direction; and a second groove located below the fourth section, the second groove extending in the front-rear direction, and wherein one end of the first groove is located above the first guide, and the other end of the first groove is connected with one end of the second groove, and wherein the other end of the second groove is located above the second guide.

9. The image forming apparatus according to claim 8, wherein the second guide has:

an upstream guide connected with the second groove, the upstream guide being configured to guide the liquid downward; and a downstream guide connected with the upstream guide, the downstream guide being configured to guide the liquid lower-rearward, the downstream guide being connected with the second outlet port.

10. The image forming apparatus according to claim 8, wherein the second cover has a second-cover side wall, the second-cover side wall having an external memory connector board on a lower surface thereof, the external memory connector board including a connector, to which an external memory is connectable, the second-cover side wall being covered with the side wall of the side cover, wherein each of the second-cover side wall and the side wall has a connector opening, in which the external memory is insertable, and wherein the second groove is extended above the connector opening of the second-cover side wall.

11. The image forming apparatus according to claim 6, wherein the near-field wireless communication board has a board opening located on an inner periphery of the antenna circuit, wherein the second cover has a snap-fit on the lower surface thereof, and wherein, the snap-fit is configured to restrict the near-field wireless communication board from separating from the second cover by, when the near-field wireless communication board approaches the lower surface of the second cover, sliding on an opening edge of the board opening and resiliently deforming to allow the near-field wireless communication wireless board to move toward the lower surface, and by, when the near-field wireless communication board stops approaching, returning to an original posture to engage with the opening edge.

12. The image forming apparatus according to claim 6, wherein said housing is a first housing, the image forming apparatus further comprising:

a second housing located above the first housing, the second housing including a reader configured to read an image of an original material; and an operation panel protruding frontward from a frontward end of the second housing, wherein the operation panel has an operative surface, a frontward edge of the operative surface being located to be lower than a rearward edge of the operative surface, and wherein the third section is located between one of widthwise edges of the operative surface located on the one side in the widthwise direction and the other of the widthwise edges of the operative surface located on the other side in the widthwise direction.

13. The image forming apparatus according to claim 1, wherein the image forming device includes a toner container and a photosensitive drum.

* * * * *